US008988301B2

(12) United States Patent
Yonetsu et al.

(10) Patent No.: US 8,988,301 B2
(45) Date of Patent: Mar. 24, 2015

(54) CORE-SHELL MAGNETIC MATERIAL, METHOD FOR PRODUCING CORE-SHELL MAGNETIC MATERIAL, DEVICE, AND ANTENNA DEVICE

(75) Inventors: Maki Yonetsu, Tokyo (JP); Tomohiro Suetsuna, Kanagawa (JP); Koichi Harada, Tokyo (JP); Seiichi Suenaga, Kanagawa (JP); Shinji Murai, Kanagawa (JP); Yasuyuki Hotta, Tokyo (JP); Toshihide Takahashi, Kanagawa (JP); Tomoko Eguchi, Tokyo (JP); Noritsugu Shiokawa, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 549 days.

(21) Appl. No.: 13/259,856

(22) PCT Filed: Nov. 27, 2009

(86) PCT No.: PCT/JP2009/006447

§ 371 (c)(1), (2), (4) Date: Nov. 2, 2011

(87) PCT Pub. No.: WO2010/109561

PCT Pub. Date: Sep. 30, 2010

(65) Prior Publication Data

US 2012/0038532 A1 Feb. 16, 2012

(30) Foreign Application Priority Data

Mar. 27, 2009 (JP) ..... 2009-078337
Nov. 27, 2009 (JP) ..... 2009-269913

(51) Int. Cl.
*H01Q 1/00* (2006.01)
*H01F 1/33* (2006.01)
(Continued)

(52) U.S. Cl.
CPC ..... *H01F 1/33* (2013.01); *B22F 1/0062* (2013.01); *B22F 1/02* (2013.01); *C22C 38/06* (2013.01);
(Continued)

(58) Field of Classification Search
USPC ..... 343/787
See application file for complete search history.

(56) References Cited

U.S. PATENT DOCUMENTS 2,488,651 A * 11/1949 Whiting et al. ..... 525/56
3,481,756 A * 12/1969 Kong ..... 428/524
(Continued)

FOREIGN PATENT DOCUMENTS

JP 02-022804 1/1990
JP 2750722 8/1990
(Continued)

OTHER PUBLICATIONS

Curt Augustsson, Epoxy Handbook, 2004, Nils Malmgren AB, 3rd, p. 3.*
(Continued)

*Primary Examiner* — Hoang V Nguyen
*Assistant Examiner* — Patrick Holecek
(74) *Attorney, Agent, or Firm* — Amin, Turocy & Watson, LLP

(57) ABSTRACT

A core-shell magnetic material having an excellent characteristic in a high-frequency band, in particular a GHz-band and a high environment resistance is provided. The core-shell magnetic material includes: a magnetic member in which plural core-shell magnetic particles are bound by a binder made of a first resin; and a coating layer that is made of a second resin different from the first resin, a surface of the magnetic member being covered with the coating layer. The core-shell magnetic material is characterized in that the core-shell magnetic particle includes a magnetic metallic particle and a covering layer that covers at least part of a surface of the magnetic metallic particle, the magnetic metallic particle contains at least one magnetic metal selected from a group consisting of Fe, Co, and Ni, and the covering layer is made of an oxide, a nitride, or a carbide that contains at least one magnetic metal.

44 Claims, 7 Drawing Sheets

(51) Int. Cl.

| | |
|---|---|
| ***B22F 1/00*** | (2006.01) |
| ***B22F 1/02*** | (2006.01) |
| ***C22C 38/06*** | (2006.01) |
| ***C22C 38/10*** | (2006.01) |
| ***H01F 1/24*** | (2006.01) |
| ***H01F 1/26*** | (2006.01) |
| ***H01F 41/02*** | (2006.01) |
| ***H01Q 1/48*** | (2006.01) |
| ***H01Q 9/28*** | (2006.01) |
| ***H01Q 9/42*** | (2006.01) |
| ***H01Q 17/00*** | (2006.01) |

(52) U.S. Cl.

CPC *C22C 38/10* (2013.01); *H01F 1/24* (2013.01); *H01F 1/26* (2013.01); *H01F 41/0246* (2013.01); *H01Q 1/48* (2013.01); *H01Q 9/28* (2013.01); *H01Q 9/42* (2013.01); *H01Q 17/00* (2013.01); *C22C 2202/02* (2013.01)

USPC ..... 343/787

(56) References Cited

U.S. PATENT DOCUMENTS

| | | | | |
|---|---|---|---|---|
| 5,183,631 | A | 2/1993 | Kugimiya et al. | |
| 6,102,980 | A | 8/2000 | Endo et al. | |
| 7,544,417 | B2 * | 6/2009 | Maeda et al. | 428/403 |
| 7,740,939 | B2 * | 6/2010 | Harada et al. | 428/403 |
| 7,936,310 | B2 * | 5/2011 | Aiga et al. | 343/787 |
| 8,305,281 | B2 * | 11/2012 | Suetsuna et al. | 343/787 |
| 8,354,037 | B2 * | 1/2013 | Harada et al. | 252/62.55 |
| 2002/0113680 | A1 | 8/2002 | Kato et al. | |
| 2007/0001921 | A1 * | 1/2007 | Takahashi et al. | 343/788 |
| 2008/0220231 | A1 | 9/2008 | Suetsuna et al. | |
| 2009/0167623 | A1 | 7/2009 | Tsujimura et al. | |
| 2010/0060538 | A1 | 3/2010 | Suetsuna et al. | |
| 2010/0060539 | A1 | 3/2010 | Suetsuna et al. | |

FOREIGN PATENT DOCUMENTS

| | | |
|---|---|---|
| JP | 2687683 | 1/1992 |
| JP | 05-347511 | 12/1993 |
| JP | 08-306520 | 11/1996 |
| JP | 10-335128 | 12/1998 |
| JP | 2006-097123 | 4/2006 |
| JP | 2007-006465 | 1/2007 |
| JP | 2007-107094 | 4/2007 |
| JP | 2009-290624 | 12/2009 |

OTHER PUBLICATIONS

Japanese Office Action for Japanese Application No. 2009-269913 mailed on Apr. 16, 2013.

International Search Report for International Application No. PCT/JP2009/006447 mailed on Feb. 2, 2010.

* cited by examiner (a)

(b)

(a)

(b)

(c)

(a)

(b)

(c)

CORE-SHELL MAGNETIC MATERIAL, METHOD FOR PRODUCING CORE-SHELL MAGNETIC MATERIAL, DEVICE, AND ANTENNA DEVICE

TECHNICAL FIELD

The present invention relates to a high-frequency magnetic material, a producing method thereof, a device in which a magnetic material is used, and an antenna device.

BACKGROUND ART

Recently, magnetic materials are applied to components of devices such as an electromagnetic wave absorber, magnetic ink and an inductance element, and an importance of the magnetic material is increased year by year. In the components, a characteristic of a magnetic permeability real part (specific magnetic permeability real part) μ' or a magnetic permeability imaginary part (specific magnetic permeability imaginary part) μ" of the magnetic material is utilized according to the intended use.

Patent Literature 1 discloses a core-shell magnetic material, in which a metallic fine particle is covered with an inorganic material in a multi-layered manner, as a high-frequency magnetic material.

In the magnetic material, depending on the intended use, there is a demand for a high environmental resistance in order to suppress a temporal change of the characteristic in use. Particularly, in the core-shell magnetic material, it is important to suppress oxidation of the inside (core) of the metallic fine particle.

CITATION LIST

Patent Literature

PTL 1: Japanese Patent Publication Laid-Open No. 2006-97123

SUMMARY OF INVENTION

Technical Problem

In view of the foregoing, an object of the invention is to provide a core-shell magnetic material having an excellent characteristic in the high-frequency band, in particular a GHz-band and the high environmental resistance, a method for producing the core-shell magnetic material, a device, and an antenna device.

Solution to Problem

According to a first aspect of the present invention, a core-shell magnetic material includes: a magnetic member in which plural core-shell magnetic particles are bound by a binder made of a first resin; and a coating layer that is made of a second resin different from the first resin, a surface of the magnetic member being covered with the coating layer, the core-shell magnetic material is characterized in that the core-shell magnetic particle includes a magnetic metallic particle and a coating layer that covers at least part of a surface of the magnetic metallic particle, the magnetic metallic particle contains at least one magnetic metal selected from a group consisting of Fe, Co, and Ni, and the covering layer is made of an oxide, a nitride, or a carbide that contains at least one magnetic metal that contained in the magnetic metallic particle.

In the core-shell magnetic material of the first aspect, preferably an oxygen permeability coefficient of the second resin is lower than an oxygen permeability coefficient of the first resin.

In the core-shell magnetic material of the first aspect, preferably a water absorption percentage of the second resin is lower than a water absorption percentage of the first resin.

In the core-shell magnetic material of the first aspect, preferably an oxygen permeability coefficient of the second resin is $1.70\times10^{-12}$ $cm^3\cdot cm/(cm^2\cdot s\cdot Pa)$ or less.

In the core-shell magnetic material of the first aspect, preferably the first resin is a resin selected from PVB, PVA, an epoxy resin, a polybutadiene resin, Teflon (registered trademark), and polystyrene and the second resin is a resin selected from the PVB, the epoxy resin, and the Teflon (registered trademark).

In the core-shell magnetic material of the first aspect, preferably the magnetic member further contains an oxide particle, a nitride particle, or a carbide particle that exists in at least part between the magnetic metallic particles and contains at least one nonmagnetic metal selected from Mg, Al, Si, Ca, Zr, Ti, Hf, Zn, Mn, a rare-earth element, Ba, and Sr.

Preferably the core-shell magnetic material of the first aspect includes a polymer compound in at least part of a surface of the core-shell magnetic particle, the polymer compound containing at least an oxyethylene unit and an amino group in a molecular chain.

In the core-shell magnetic material of the first aspect, preferably the first resin contains a polymer compound including at least an oxyethylene unit and an amino group in a molecular chain.

In the core-shell magnetic material of the first aspect, preferably a hydroxyl group existing in a molecular chain of the first resin or the second resin is 30% or less per repeating unit.

In the core-shell magnetic material of the first aspect, preferably the first resin is a polyvinyl polymer compound having a main backbone made of a hydrocarbon chain, and the second resin is an epoxy resin.

In the core-shell magnetic material of the first aspect, preferably the first resin is a polymer compound containing at least a butyral unit in a polyvinyl backbone, and the second resin is an epoxy resin having a hardener component of an acid anhydride.

According to a second aspect of the present invention, a core-shell magnetic material producing method includes the steps of: producing a magnetic metallic particle made of a magnetic metal and a nonmagnetic metal; forming a core-shell particle by oxidizing, nitriding, or carbonizing the magnetic metallic particle; preparing a kneading matter by mixing the core-shell magnetic particle in liquid containing a first resin; forming a magnetic member by molding the kneading matter; and forming a coating layer by impregnating a surface of the magnetic member with a second resin, the method is characterized in that the magnetic metal is at least one magnetic metal selected from a group consisting of Fe, Co, and Ni, and the nonmagnetic metal is at least one nonmagnetic metal selected from Mg, Al, Si, Ca, Zr, Ti, Hf, Zn, Mn, a rare-earth element, Ba, and Sr.

In the core-shell magnetic material producing method of the second aspect, preferably a solid solution powder of the magnetic metal and the nonmagnetic metal and a nonmagnetic metallic powder are used as a raw material in the magnetic metallic particle producing step.

In the core-shell magnetic material producing method of the second aspect, preferably the coating layer forming step is performed under reduced pressure.

According to a third aspect of the present invention, a core-shell magnetic material producing method includes the steps of: producing a magnetic metallic particle made of a magnetic metal and a nonmagnetic metal; forming a core-shell magnetic particle by oxidizing, nitriding, or carbonizing the magnetic metallic particle; preparing a dispersion liquid in which the core-shell magnetic particles are dispersed in a solvent by mixing the core-shell magnetic particles in the solvent containing a polymer compound including at least an oxyethylene unit and an alkylamino group in a molecular chain and a polymer compound having a main backbone made of a hydrocarbon chain; and forming a film by molding the dispersion liquid, the method is characterized in that the magnetic metal is at least one magnetic metal selected from a group consisting of Fe, Co, and Ni, and the nonmagnetic metal is at least one nonmagnetic metal selected from Mg, Al, Si, Ca, Zr, Ti, Hf, Zn, Mn, a rare-earth element, Ba, and Sr.

In the core-shell magnetic material producing method of the third aspect, preferably a vapor pressure of the solvent is 10 mmHg or more at 20° C.

According to a fourth aspect of the present invention, a device is characterized by including the core-shell magnetic material of the above-described aspect.

According to a fifth aspect of the invention, an antenna device is characterized by including the core-shell magnetic material of the above-described aspect.

According to a sixth aspect of the invention, an antenna device comprises: a finite ground plane; a rectangular conductor plate that is provided above the finite ground plane, one side of the rectangular conductor plate being connected to the finite ground plane, the rectangular conductor plate including a bent portion substantially parallel to the one side; an antenna that is disposed above the finite ground plane in substantially parallel with the finite ground plane, the antenna extending in a direction substantially perpendicular to the one side, a feeding point of the antenna being located near the other side disposed opposite the one side of the rectangular conductor plate; and a magnetic body that is provided to at least part of a space between the finite ground plane and the antenna, the antenna device is characterized in that the magnetic body is the core-shell magnetic material of the above-described aspect.

According to a seventh aspect of the present invention, an antenna device is characterized by including: the core-shell magnetic material of the above-described aspect, and an antenna element that is formed around the core-shell magnetic material.

According to an eighth aspect of the present invention, an antenna device includes: the core-shell magnetic material of the above-described aspect, and an antenna element that is formed around the core-shell magnetic material, the antenna device is characterized in that a predetermined spacing is formed between the core-shell magnetic material and the antenna element.

According to a ninth aspect of the present invention, an antenna device includes: the core-shell magnetic material of the above-described aspect, and an antenna element that is formed around the core-shell magnetic material, the antenna device is characterized in that a predetermined spacing is formed between the magnetic material and the antenna element, and the spacing ranges from 0.01 mm to 1 mm.

According to a tenth aspect of the present invention, an antenna device includes: the core-shell magnetic material of the above-described aspect, and an antenna element that is formed around the core-shell magnetic material, the antenna device is characterized in that a dielectric body having permittivity lower than that of the core-shell magnetic material is inserted between the core-shell magnetic material and the antenna element.

According to an eleventh aspect of the present invention, a magnetic material includes: a magnetic member in which a plurality of non-core-shell magnetic particles are bound by a binder made of a first resin; and a coating layer that is made of a second resin different from the first resin, a surface of the magnetic member being covered with the coating layer, the magnetic material is characterized in that the first resin is a polyvinyl polymer compound having a main backbone made of a hydrocarbon chain, the second resin is an epoxy resin, and the magnetic particle contains at least one magnetic metal selected from a group consisting of Fe, Co, and Ni.

According to a twelfth aspect of the present invention, a magnetic material includes: a magnetic member in which a plurality of non-core-shell magnetic particles are bound by a binder made of a first resin; and a coating layer that is made of a second resin different from the first resin, a surface of the magnetic member being covered with the coating layer, the magnetic material is characterized in that the first resin is a polymer compound containing at least a butyral unit in a polyvinyl backbone, and the second resin is an epoxy resin having a hardener component of an acid anhydride, and the magnetic particle contains at least one magnetic metal selected from a group consisting of Fe, Co, and Ni.

Advantageous Effects of Invention

According to the invention, the core-shell magnetic material having the excellent characteristic in the high-frequency band, in particular the GHz-band and the high environment resistance, the method for producing the core-shell magnetic material, the device, and the antenna device can be provided.

DESCRIPTION OF EMBODIMENT

Hereinafter, embodiments of the present invention will be described with reference to the drawings.

(First Embodiment)

A core-shell magnetic material according to an above-described embodiment includes a magnetic member in which plural core-shell magnetic particles are bound by a binder made of a first resin and a coating layer that is made of a second resin different from the first resin to cover a surface of the magnetic member therewith. The core-shell magnetic particle includes a magnetic metallic particle (core) and a covering layer (shell) that covers at least part of a surface of the magnetic metallic particle, the magnetic metallic particle contains at least one magnetic metal selected from a group consisting of Fe, Co, and Ni, and the covering layer is made of an oxide, a nitride, or a carbide containing at least one magnetic metal that contained in the magnetic metallic particle.

As used herein, the core-shell magnetic particle is a magnetic particle that is covered with a shell composition in a range of 50% to 100% with respect to the surface of the particle. That is, the core-shell magnetic particle is the magnetic particle in which a covering ratio of the shell composition ranges from 50% to 100%. Although preferably the particle has a spherical shape, the particle may be formed into a square shape. The connected particles are taken as one particle. In measurement of the covering ratio, for example, the particles are observed with a transmission electron microscope, and the covering ratio is measured with respect to at least 20 particles. It is assumed that the covering ratio of the particles is an average value of the measurement. A magnetic particle except the core-shell magnetic particle is referred to as a non-core-shell magnetic particle.

Figure 1:
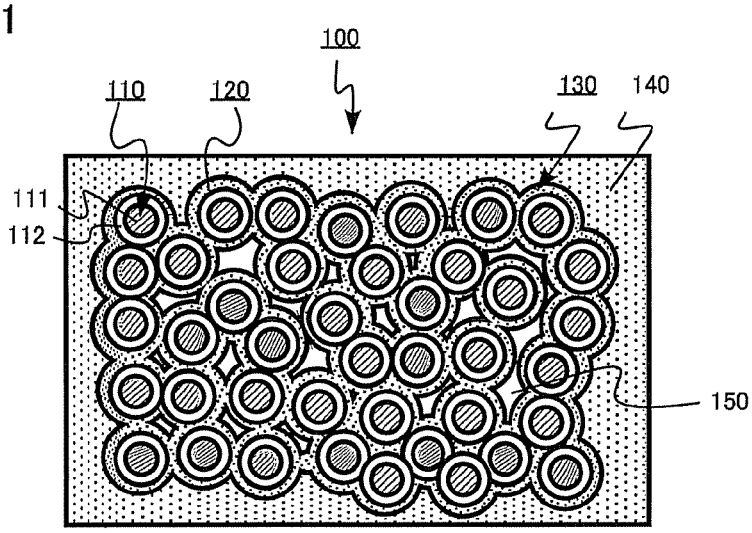
FIG. 1 is a schematic sectional view of a core-shell magnetic material according to a first embodiment.

FIG. 1 is a schematic sectional view of a core-shell magnetic material according to a first embodiment. A core-shell magnetic material 100 includes a magnetic member 130 in which plural core-shell magnetic particles (or core-shell nano magnetic particles) 110 having sizes of about 10 nm to about 30 nm (nanometer order) are bound by a binder 120 made of the first resin. The core-shell magnetic material 100 includes a coating layer 140 that is made of the second resin different from the first resin to cover the surface of the magnetic member 130 therewith.

The core-shell magnetic particle 110 includes a magnetic metallic particle (core) 111 and a covering layer (shell) 112 that covers at least part of the surface of the magnetic metallic particle, the magnetic metallic particle 111 contains at least one magnetic metal selected from the group consisting of Fe, Co, and Ni, and the covering layer is made of the oxide, the nitride, or the carbide containing at least one magnetic metal.

In the case that the core-shell magnetic particle is used as the magnetic material, a magnetic characteristics such as magnetic permeability fluctuates when the magnetic metallic particle of the core is oxidized. Accordingly, it is important to prevent the oxidation of the magnetic metallic particle. Therefore, the oxidation of the magnetic metallic particle is suppressed by providing the covering layer (shell) on the surface of the magnetic metallic particle.

However, for example, in the case that the magnetic material is mounted on an instrument that is used under a severe environment such as high-temperature and high humidity, occasionally the oxidation suppression effect on the magnetic metallic particle can insufficiently be secured only by the covering layer (shell).

The core-shell magnetic material 100 of the first embodiment having the above configuration makes a core-shell magnetic material having the excellent characteristic in the high-frequency band, in particular the GHz-band. Oxygen and moisture are prevented from invading in the magnetic member 130 by covering the surface of the magnetic member 130 with the coating layer 140, thereby further preventing the oxidation of the magnetic metallic particle. Therefore, the core-shell magnetic material having the excellent characteristic in the high-frequency band, in particular the GHz-band and the high environment resistance can be made.

Desirably the outer surface of the magnetic member 130 is completely covered with the coating layer 140 from the viewpoint of securing an oxidation resistance. Desirably a void 150 in the magnetic member 130 is filled with the second resin constituting the coating layer 140 from the viewpoints of further improving the oxidation resistance and of improving mechanical strength of the magnetic material 100.

Preferably an insulating material constituting the coating layer is selected from at least one material of a group consisting of an epoxy resin, a polyester resin, a polyolefin resin, a polyimide resin, a polystyrene resin, a polyvinyl resin, a polyurethane resin, a cellulose resin, an ABS resin, a polybenzoxazole resin, a polyphenylene resin, a polybenzocyclobutene resin, a polyarylene ether resin, a polysiloxane resin, a cyanate ester resin, a polyphenylene ether resin, a fluorine resin, a liquid crystal polymer, a cyanoacrylate resin, a polyamide resin, a nitrile-butadiene rubber, a styrene-butadiene rubber, a phenol resin, an amide resin, and an imide resin. Specifically, PVB, PVA, polyethylene, polybutadiene, polypropylene, polyimide, polyester, PVP, or a copolymer thereof is used.

The first resin and the second resin constituting the magnetic material of the first embodiment may contain the following inorganic material, and have a configuration in which $Al_2O_3$ is dispersed in the epoxy resin. The first resin and the second resin may contain inorganic materials such as the oxide, the nitride, and the carbide. $Al_2O_3$, AlN, $SiO_2$, and SiC can be cited as an example of the inorganic material. Preferably the inorganic material contained in a low-permittivity magnetic material of the first embodiment has low permittivity because the low-permittivity magnetic material has the low permittivity in a necessary frequency band. As to a method for containing the inorganic material contained in the low-permittivity magnetic material, the inorganic material may be added during mixing or during molding. A material contained as an impurity in a raw material or a particle generated in forming a core shell of a particle may be used.

From the viewpoint of reliability of the core-shell magnetic material, preferably a glass-transition temperature of the resin is, but is not limited to, 60° C. or more, more preferably 85° C. or more.

Examples of the first resin and the second resin include a polyvinyl butyral resin (PVB), a polyvinyl alcohol resin (PVA), an epoxy resin, a polybutadiene resin, Teflon (registered trademark), a polystyrene resin, a polyester resin, a polyethylene resin, a polyvinyl chloride resin, a polyurethane resin, a cellulose resin, an ABS resin, a nitrile-butadiene rubber, a styrene-butadiene rubber, a phenol resin, an amide resin, an imide resin, or a copolymer thereof.

In the first resin, a heat resistance of 85° C. or more and the low permittivity at high frequencies are demanded in addition to the moldability. However, the permittivity of the first resin depends on the device. Generally the first resin having the low permittivity is preferably used. However, in the case that the first resin is used in an ultracompact antenna board, preferably miniaturization can be promoted by a wavelength shortening effect as the first resin has the higher permittivity. The first resin having the low permittivity is preferably used in the case that the first resin is used in a broadband antenna board. Therefore, it is necessary to select the resin having the proper permittivity according to the device. In the following description, it is assumed that the resin is used in the device in which the low permittivity is demanded.

In the second resin, there is a demand for an effect as a protective film that suppresses the characteristic degradation caused by the oxidation of the magnetic metallic particle. Therefore, preferably the second resin has low oxygen permeability, low moisture permeability, and low moisture absorbency (low water absorbency) in addition to the high heat resistance and the high mechanical strength.

Accordingly, preferably the oxygen permeability coefficient of the second resin is lower than that of the first resin. Preferably the water absorption percentage of the second resin is lower than that of the first resin.

In particular, preferably the oxygen permeability coefficient of the second resin is $1.70\times10^{-12}$ $cm^3\times cm/(cm^2\times s\times Pa)$ or less. In the case that the oxygen permeability coefficient of the second resin is larger than $1.70\times10^{-12}$ $cm^3\times cm/(cm^2\times s\times Pa)$, the oxygen passes through the coating layer to oxidize the core-shell magnetic particle, which possibly results in a risk of decreasing the permeability. Therefore, preferably the oxygen permeability coefficient falls within the above numerical range in order to obtain high reliability.

The oxygen permeability coefficient can be measured by a method described in C. J. Major, etc., Modern Plastics, 39, 135 (July 1962), A. Lebovits, Modern Plastics, 43, 139 (March 1966). The water absorption percentage can be measured by a method prescribed in JIS-K-6911.

In both the first resin and the second resin, the low real part of the permittivity and a low-dielectric loss (imaginary part of permittivity/real part of permittivity) are demanded at high frequencies. Specifically, the permittivity is 50 or less, more preferably 20 or less, and the dielectric loss is 20% or less, more preferably 10% or less. Because the antenna characteristic is degraded at high frequencies when the permittivity is increased, preferably the permittivity is decreased as low as possible.

From the above viewpoints, preferably a resin selected from a homopolymer or a copolymer of a polyolefin resin, a polyvinyl resin, PVB, PVA, a polycycloolefin resin, a polyacetal resin, an epoxy resin, a polybutadiene resin, Teflon (registered trademark), and a polystyrene resin is used as the first resin, and preferably a resin selected from a homopolymer or a copolymer of PVB, an epoxy resin, Teflon (registered trademark), a liquid crystal polymer, a cyanoacrylate resin, a polyamide resin, a polystyrene resin, an ethylcellulose resin, a polyvinyl acetate resin, a polyacrylonitrile resin, PET, a polyphenyl ether resin, a polyacetal resin, a polyurethane resin, and a polyimide resin is used as the second resin.

Among others, more preferably a polyvinyl resin is used as the first resin and an epoxy resin is used as the second resin. In the first polyvinyl resin, more preferably a polyvinyl butyral resin having at least a butyral unit is used as the first resin and an epoxy resin is used as the second resin.

A polymer in which at least part of unit constituting the polymer is acetalized from a polyvinyl alcohol, generally obtained by a saponification reaction by a polyvinyl acetate, by an acetal reaction is used as the polyvinyl resin for the first resin. An acetal reaction process is one in which the polyvinyl alcohol and an aldehyde are acetalized in the presence of an acid catalyst. Examples of the aldehyde used herein include aliphatic aldehydes such as a formaldehyde, paraformaldehyde, an acetaldehyde, a paraacetaldehyde, a propionaldehyde, an n-butylaldehyde, a hexylaldehyde, a heptylaldehyde, and a 2-ethylhexylaldehyde, alicyclic aldehydes such as a cyclohexylaldehyde, heterocyclic aldehydes such as a furflural and a thiophene-2-carbaldehyde, aromatic aldehydes such as a benzaldehyde, a 2-methylbenzaldehyde, a 3-methylbenzaldehyde, a 4-methylbenzaldehyde, a phenylacetaldehyde, and a β-phenylpropionaldehyde, and aldehydes including alicyclic substitution groups such as a norbornyl, a cyclopentadienyl, and an adamantyl with respect thereto. The aldehyde may singly be used, or at least two kinds of aldehydes may be used as needed basis. Preferably, the polymer having the butyral unit in the molecular chain is formed using at least butylaldehyde in the above aldehydes.

At this point, more preferably, the residual vinyl alcohol unit is 30 unit % or less in a polymer unit. When the vinyl alcohol unit is more than 30 unit %, it is not preferable that the water absorption percentage or the permittivity is increased to degrade the characteristics and the reliability of the magnetic material.

The epoxy resin used in the second resin is a composition containing an epoxy resin, a hardener, and a curing accelerator. There is no particular limitation to the epoxy resin as long as the epoxy resin has at least two epoxy groups in one molecule.

Specifically, examples of the epoxy resin include a bisphenol F type epoxy resin, a bisphenol A type epoxy resin, a phenol novolac type epoxy resin, a cresol novolac type epoxy resin, a naphthol novolac type epoxy resin, a bisphenol A novolac type epoxy resin, a naphthalene diol type epoxy resin, an alicyclic epoxy resin, an epoxy compound derived from a tri- or tetra(hydroxyphenyl)-alkane, a bis-hydroxybiphenyl epoxy resin, a dihydroxydiphenylmethane epoxy resin, an epoxidation substance of a phenolaralkyl resin, a heterocyclic epoxy resin, and an aromatic diglycidylamine compound.

At least two kinds of the epoxy resins may be used while mixed together. Preferably the epoxy resin is a liquid substance at room temperature. In the case that the bisphenol F type epoxy resin is used in the above epoxy resins, viscosity of the resin composition is decreased, and the bisphenol F type epoxy resin is excellent for storage stability. Therefore, in the case that the epoxy resins are mixed together, preferably the bisphenol F type epoxy resin is used as at least one of epoxy resin matrixes.

There is no particular limitation to the hardener used in the first embodiment. However, most preferably an acid anhydride hardener is used in consideration of fluidity of the resin composition. Specifically, examples of the acid anhydride hardener include a methyltetrahydrophthalic acid anhydride, a methylhexahydrophthalic acid anhydride, a methyl endomethylenetetrahydrophthalic acid anhydride, a trialkyltetrahydrophthalic acid anhydride, and a dodecenyl succinic acid anhydride.

At least two kinds of the acid anhydrides may be used while mixed together. Preferably the acid anhydride is a liquid substance at room temperature. Another hardener may be used along with the above acid anhydride hardener within a range the fluidity and the storage stability are not degraded.

Specifically, examples of another hardener includes: acid anhydrides, such as a phthalic acid anhydride, a tetrahydrophthalic acid anhydrid, a hexahydrophthalic acid anhydride, a pyromellitic acid anhydride, a trimellitic acid anhydride, an endomethylenetetrahydrophthalic acid anhydride, and a nadic acid anhydride, which are a solid-state substance at room temperature; novolac type phenol resins such as a phenol novolac resin, a cresol novolac resin, a t-butylphenol novolac resin, a nonylphenolcresol novolac resin, a bisphenol A, and a naphthol novolac resin and allyl group introduction compounds thereof; a poly paraoxystyrene; phenolaralkyl resins such as a condensation polymer compound of a 2,2'-dimethoxy-p-xylene and a phenol monomer; a dicyclopentadiene-phenol polymer; multifunctional phenol resins such as a tris (hydroxyphenyl)-alkane; and a phenol resin having a terpene backbone.

At least two kinds of the hardeners may be used. There is no particular limitation to a composition amount of the hardener. However, preferably an equivalent ratio (reactive group of hardener/epoxy group) of the epoxy resin and the hardener ranges from 0.5 to 1.5. A hardening reaction insufficiently takes place when the equivalent ratio is lower than 0.5, and there is a risk of degrading physical properties of a hardened substance, particularly a humidity resistance when the equivalent ratio is more than 1.5. More preferably the equivalent ratio ranges from 0.8 to 1.2.

There is no particular limitation to the hardening accelerator used in the first embodiment. Any compound may be used as long as the compound is a latent catalyst exerting catalytic activity at temperatures of 60° C. or more. When the temperature at which the catalytic activity is exerted is lower than 60° C., the storage stability of the resin composition is significantly degraded and the resin composition cannot stably be stored for long periods. Additionally, when the temperature at which the catalytic activity is exerted is lower than 60° C., the viscosity is increased during flow of the resin to degrade the moldability in a process of covering the magnetic material.

Specifically, examples of the latent hardening accelerator include: high-melting-point degraded catalysts, such as a dicyandiamide, a high-melting-point imidazole compound, organic acid dihydrazides, an aminomaleonitrile, a melamine and a derivative thereof, and polyamines, which dissolve the epoxy resin at high temperature to exhibit activity; basic catalysts, such as an aminimide compound, a tertiary amine salt soluble in the epoxy resin, and an imidazole salt soluble in the epoxy resin, which are dissolved and activated at high temperature; high-temperature disassociation type cationic polymerization catalysts such as a Lewis acid salt and a Lewis acid complex typified by a monoethylamine salt of a boron trifluoride and a Broenstead acid salt typified by an aliphatic sulfonium salt of a Broenstead acid; and adsorption type catalysts in which the catalyst is adsorbed by a compound, such as a molecular sieve and a zeolite, which has a vacancy.

Particularly preferably, from the viewpoints of the environment resistance and the productivity, the first resin is the polyvinyl polymer compound in which the hydrocarbon chain constitutes the main backbone and the second resin is the epoxy resin.

Particularly preferably, from the viewpoints of the environment resistance and the productivity, the first resin is the polymer compound containing at least the butyral unit in the polyvinyl backbone, the second resin is the epoxy resin in which the acid anhydride is used as the hardener component.

In the core-shell magnetic particle, when a mechanical force is applied to the particle, the covering layer (shell) is peeled off to possibly degrade the oxidation resistance of the particle. Preferably a soft, relatively slippery resin is used as the first resin in order to achieve a high filling rate of the core-shell magnetic particle. Therefore, possibly the mechanical strength is insufficiently obtained only by the first resin. Accordingly, from the viewpoint of preventing the peel-off of the covering layer, preferably the resin having the high mechanical strength is used as the second resin different from the first resin.

As to a volume ratio in the magnetic member, preferably the core-shell magnetic particle occupies the volume ratio of 10% to 70% with respect to the whole magnetic member. When the volume ratio is more than 70%, an electric resistance of the sheet is decreased to increase an eddy current loss and therefore possibly the high-frequency magnetic characteristic is degraded. When the volume ratio is lower than 10%, saturation magnetization of the magnetic member is decreased by decreasing a volume fraction of the magnetic metal, thereby possibly decreasing the permeability.

Preferably the first resin and the second resin occupy the total of volume ratios of 5% to 80% in the magnetic member. When the total of volume ratios is lower than 5%, the particles does not adhere to each other to possibly degrade the strength of the magnetic member. When the total of volume ratios is more than 80%, the volume ratio of the magnetic metal to the magnetic member is decreased to possibly decrease the permeability.

It is necessary that the volume ratio of the first resin be 50% or less in the magnetic member, and it is necessary that the volume ratio of the second resin be lower than that of the first resin and range from 1% to 30%. When the volume ratio of the first resin is more than 50%, a mixed volume ratio of the first resin and the second resin cannot be suppressed to 80% or less, and the resultant volume fraction of the magnetic metal is decreased.

The protective effect is insufficiently exerted when the volume ratio of the second resin is lower than 1%, and the volume fraction of the magnetic metal is decreased when the volume ratio of the second resin is 30% or more. Preferably the coating layer mainly containing the second resin has thicknesses of 1 μm or more. When the thickness of the second resin is 1 μm or less, the second resin insufficiently exerts the effect as the protective film.

The magnetic member may have a stacked structure. Not only the magnetic member can easily be thickened by the stacked structure, but also the high-frequency magnetic characteristic can be improved by alternately stacking the magnetic member and a nonmagnetic insulating layer. A magnetic layer including the core-shell magnetic particles is formed into a sheet shape having thicknesses of 100 μm or less, and the sheet-shaped magnetic layer and a nonmagnetic insulating oxide layer having thicknesses of 100 μm or less are alternately stacked to form the stacked structure, thereby improving the high-frequency magnetic characteristic. When the single magnetic layer has thicknesses of 100 μm or less, an influence of a diamagnetic field can be reduced in applying the high-frequency magnetic field in an in-plane direction, and not only the permeability can be increased but also the high-frequency characteristic of the permeability is improved. There is no particular limitation to the stacking method. For example, the plural magnetic layers are pressed, heated, and sintered, thereby forming the stacked structure.

The magnetic metallic particle contains at least one magnetic metal selected from the group consisting of Fe, Co, and Ni, and particularly an Fe-base alloy, a Co-base alloy, and an FeCo-base alloy are preferably used as the magnetic metal because the high saturation magnetization can be achieved. An FeNi alloy, an FeMn alloy, and an FeCu alloy, which contain Ni, Mn, and Cu as the second component, can be cited as an example of the Fe-base alloy. A CoNi alloy, a CoMn alloy, and a CoCu alloy, which contain Ni, Mn, and Cu as the second component, can be cited as an example of the Co-base alloy. An alloy that contains Ni, Mn, and Cu as the second component can be cited as an example of the FeCo-base alloy. The second component is effectively improves the high-frequency magnetic characteristic of the core-shell magnetic particle.

In the magnetic metals, particularly the FeCo-base alloy is preferably used. Preferably a Co content in FeCo ranges from 10 at % to 50 at % from the viewpoint of satisfying thermal stability, the oxidation resistance, and the saturation magnetization of 2 tesla or more. More preferably the Co content in FeCo ranges from 20 at % to 40 at % from the viewpoint of further enhancing the saturation magnetization.

Preferably the magnetic metallic particle contains the nonmagnetic metal. The nonmagnetic metal is at least one metal that is selected from the group consisting of Mg, Al, Si, Ca, Zr, Ti, Hf, Zn, Mn, a rare-earth element, Ba, and Sr. The nonmagnetic metal is an element that is easily oxidized because the oxide thereof has small standard Gibbs energy of formation, and the nonmagnetic metal is contained as one of structural components of the oxide covering layer that covers the magnetic metallic particle. Therefore, the insulating property of the nonmagnetic metal can stably be provided. Among others, Al and Si easily form a solid solution alloy of Fe, Co, and Ni that are of the main components of the magnetic metallic particle, and preferably Al and Si are used to contribute to the improvement of the thermal stability of the core-shell magnetic particle. Particularly, Al is preferably used because the thermal stability and the oxidation resistance are improved.

Preferably carbon and nitrogen are contained either alone or with each other in the magnetic metallic particle. At least one of the carbon and the nitrogen forms a solid solution alloy with the magnetic metal to be able to increase magnetic anisotropy of the core-shell magnetic particle. Because the high-frequency magnetic material that contains the core-shell magnetic particle having the large magnetic anisotropy can increase a ferromagnetic resonance frequency, the high-frequency magnetic material can maintain the high permeability at the high-frequency band, and the high-frequency magnetic material is suitably used at the high-frequency band.

Preferably, the magnetic metallic particle contains the nonmagnetic metal and at least one element selected from the carbon and the nitrogen in addition to the magnetic metal, and each of the nonmagnetic metal and one of the carbon and the nitrogen (or total of the carbon and the nitrogen in the case of coexistence) ranges from 0.001 at % to 20 at % with respect to the magnetic metal. When each of the nonmagnetic metal and at least one element selected from the carbon and the nitrogen is more than 20 at %, there is a risk of decreasing the saturation magnetization of the magnetic particle. From the viewpoints of the high saturation magnetization and the solid solubility, preferably each of the nonmagnetic metal and at least one element selected from the carbon and the nitrogen ranges from 0.001 at % to 5 at %, and more preferably ranges from 0.01 at % to 5 at %.

Particularly, in the magnetic metallic particle containing the FeCo-base alloy as the magnetic metal and the carbon (C) selected from the carbon and the nitrogen as the nonmagnetic metal, at least one element selected from Al and Si is contained, preferably at least one element selected from Al and Si (or the total of Al and Si in the case of coexistence) ranges from 0.001 at % to 5 at % with respect to FeCo, more preferably ranges from 0.01 at % to 5 at %, and preferably the carbon ranges from 0.001 at % to 5 at % with respect to FeCo, more preferably ranges from 0.01 at % to 5 at %. The magnetic metal is the FeCo-base alloy, the magnetic metallic particle contains the carbon and at least one element selected from Al and Si, and each of the carbon and at least one element selected from Al and Si ranges from 0.001 at % to 5 at % with respect to FeCo. In this case, particularly the magnetic anisotropy and the saturation magnetization can well be maintained, and therefore the permeability can be increased at the high-frequency band.

For example, a composition analysis of the magnetic metallic particle can be performed by the following methods. An ICP emission analysis, TEM-EDX, XPS, and SIMS can be cited as an example of the analysis of the nonmagnetic metal such as Al. In the ICP emission analysis, analytical results of the magnetic metallic particle (core) dissolved by a weak acid, the residue (oxide shell) dissolved by an alkali or a strong acid, and the whole particle are compared to one another, and the composition of the magnetic metallic particle can be confirmed, namely, the amount of nonmagnetic metal in the magnetic metallic particle can be measured.

In the TEM-EDX, a beam of EDX is focused, and the magnetic metallic particle (core) and the oxide covering layer (shell) are irradiated with the EDX to perform a semi-quantitative analysis, which allows the composition of the magnetic metallic particle to be roughly confirmed. In the XPS, a bonding state of the elements constituting the magnetic metallic particle can also be checked. Because it is difficult to form the solid solution of elements such as the carbon and the nitrogen in the shell portion, it is assumed that the solid solution of the carbon and the nitrogen is formed on the core side that is of the magnetic metallic particle, and the carbon and the nitrogen can be measured by analyzing the composition of the whole magnetic metallic particle using the ICP emission analysis, an infrared absorption method, and a thermal conductivity method. The small amount nonmagnetic metal such as Al and Si and the small amount of elements such as the carbon and the nitrogen can be measured in the magnetic metallic particle by the composition analysis of the magnetic metallic particle.

In the case that the magnetic metallic particle contains at least one element selected from the nonmagnetic metal, the carbon, and the nitrogen, preferably the solid solution of at least one element selected from the nonmagnetic metal, the carbon, and the nitrogen in the magnetic metal is formed. The magnetic anisotropy is effectively improved by the solid solution, so that the high-frequency magnetic characteristic can be improved. The mechanical characteristic of the core-shell magnetic particle can be improved by the solid solution. When the nonmagnetic metal, the carbon, and the nitrogen are segregated in a grain boundary or a surface of the magnetic metallic particle without forming the solid solution, possibly it is difficult to effectively improve the mechanical characteristic.

In the magnetic metallic particle, whether the magnetic metal and at least one element selected from the nonmagnetic metal, the carbon, and the nitrogen forms the solid solution can be determined from a lattice constant measured by XRD (X-ray Diffraction). For example, when Fe contained as the magnetic metal, Al contained as the nonmagnetic metal, and the carbon form the solid solution in the magnetic metallic particle, the lattice constant of Fe changes according to a solid solution amount. In the case of bcc-FE in which the solid solution is not formed, the lattice constant is ideally about 2.86. The lattice constant is increased when the solid solution of Al is formed, and the lattice constant is increased by about 0.005 to about 0.01 when the solid solution of Al of about 5 at % is formed. The lattice constant is increased by about 0.01 to about 0.02 when the solid solution of Al of about 10 at % is formed. The lattice constant is increased when the solid solution of the carbon in bcc-Fe is formed, and the lattice constant is increased by about 0.001 when the solid solution of the carbon of about 0.02 wt % is formed. The lattice constant of the magnetic metal is fixed by the XRD measurement of the magnetic metallic particle, and whether the solid solution in the magnetic metal is formed can easily be determined, or how much the solid solution of the nonmagnetic metal, the carbon, or the nitrogen in the magnetic metal is formed can easily be determined. Whether the solid solution is formed can also be confirmed from a diffraction pattern of the particle with the TEM or a high-resolution TEM photograph.

A crystal structure of the magnetic metal changes slightly with decreasing particle diameter of the magnetic metallic particle, or the crystal structure is also changes by taking a core-shell structure including the magnetic metallic particle and the oxide covering layer. This is because a strain is generated at an interface between the core and the shell by reducing the size of the core magnetic metal or by taking the core-shell structure. It is necessary that the lattice constant be comprehensively determined in consideration of these effects. In the case of the combination of Fe—Al—C, as described above, most preferably the composition amount of each of Al and C ranges from 0.01 at % to 5 at %, and the solid solution of Al and C in Fe is formed. Preferably the lattice constant of Fe becomes about 2.86 to about 2.90, more preferably becomes about 2.86 to about 2.88 by the solid solution of Al and C in Fe and the core-shell structure of the particle and the covering layer.

In the case of the combination of FeCo—Al—C, as described above, most preferably the composition amount of Co contained in FeCo ranges from 20 at % to 40 at %, the composition amount of each of Al and C ranges from 0.01 at % to 5 at %, and the solid solution of Al and C in FeCo is formed. Preferably the lattice constant of FeCo becomes about 2.85 to about 2.90, more preferably becomes about 2.85 to about 2.88 by the solid solution of Al and C in FeCo and the core-shell structure of the particle and the covering layer.

The magnetic metallic particle may be constructed by either a polycrystal or a single crystal. However, preferably the magnetic metallic particle is constructed by the single crystal. When the high-frequency magnetic material is made by integrating the core-shell magnetic particle including the single-crystal magnetic metallic particle, the axes of easy magnetization can be aligned to control the magnetic anisotropy, so that the high-frequency characteristic can be improved compared with the high-frequency magnetic material containing the core-shell magnetic particle including the polycrystalline magnetic metallic particle.

The average particle diameter of the magnetic metallic particle ranges from 1 nm to 1000 nm, preferably ranges from 1 nm to 100 nm, and more preferably ranges from 10 nm to 50 nm. When the average particle diameter is lower than 10 nm, superparamagnetism is generated to possibly decrease a magnetic flux amount. On the other hand, when the average particle diameter is more than 1000 nm, the eddy current loss is increased in the high-frequency range, and possibly the magnetic characteristic is degraded in the intended high-frequency range. In the core-shell magnetic particle, when the particle diameter of the magnetic metallic particle is increased, a multi-domain structure energetically becomes more stable than a single-domain structure as a magnetic structure. At this point, the core-shell magnetic particle having the multi-domain structure is lower than the core-shell magnetic particle having the single-domain structure in the high-frequency characteristic of the permeability.

In the case that the core-shell magnetic particle is used as the high-frequency magnetic member, preferably the core-shell magnetic particle exists as the magnetic metallic particle having the single-domain structure. Because the magnetic metallic particle in which the single-domain structure is maintained has a limit particle diameter of about 50 nm or less, preferably the average particle diameter of the magnetic metallic particle is 50 nm or less. Therefore, the average particle diameter of the magnetic metallic particle ranges from 1 nm to 1000 nm, preferably ranges from 1 nm to 100 nm, more preferably ranges from 10 nm to 50 nm. More preferably the average particle diameter of the magnetic metallic particle ranges from 10 nm to 30 nm. When the average particle diameter falls within the range, a coercive force of the magnetic material is decreased, and therefore the high-frequency permeability is further increased. Preferably the coercive force of the magnetic material is decreased, more preferably the coercive force of the magnetic material ranges from 15920 A/m (200 Oe) to 47750 A/m (600 Oe).

The magnetic metallic particle may be formed into the spherical shape. Preferably the magnetic metallic particle is formed into a flattened or rod shape so as to have a large aspect ratio (for example, 10 or more). The rod shape includes a spheroid. As used herein, the "aspect ratio" means a ratio of a height and a diameter (height/diameter). In the case of the spherical shape, the aspect ratio becomes 1 because the height and the diameter are equal to each other. The aspect ratio of the flattened particle is (diameter/height). The aspect ratio of the rod shape is (length of rod/diameter of bottom surface of rod). However, the aspect ratio of the spheroid is (long axis/short axis).

When the aspect ratio is increased, the magnetic anisotropy can be provided by the shape to improve the high-frequency characteristic of the permeability. Additionally, when the desired member is prepared by integrating the core-shell magnetic particles, the member can easily be oriented by the magnetic field to further improve the high-frequency characteristic of the permeability. The limit particle diameter of the magnetic metallic particle constituting the single-domain structure can be increased, for example, the particle diameter larger than 50 nm can be formed by increasing the aspect ratio. In the case of the spherical magnetic metallic particle, the limit particle diameter of the single-domain structure is about 50 nm.

The limit particle diameter can be increased in the flattened magnetic metallic particle having the large aspect ratio, and the high-frequency characteristic of the permeability is not degraded. Because generally the synthesis is easily performed in the particle having the larger particle diameter, the large aspect ratio has an advantage from the viewpoint of production. When the desired member is prepared by integrating the core-shell magnetic particles having the magnetic metallic particles, because the filling rate can be increased by increasing the aspect ratio, the saturation magnetization can be increased per unit volume or unit weight of the member, and therefore the permeability can also be increased.

The covering layer that covers at least part of the surface of the magnetic metallic particle is made of an oxide, a complex oxide, a nitride, or a carbide, which contains at least one of the magnetic metals that are of the structural component of the magnetic metallic particle. Preferably the covering layer is the oxide, the complex oxide, the nitride, or the carbide, which contains at least one nonmagnetic metal selected from the group consisting of Mg, Al, Si, Ca, Zr, Ti, Hf, Zn, Mn, a rare-earth element, Ba, and Sr. In the case that the magnetic metallic particle contains at least one nonmagnetic metal selected from the group consisting of Mg, Al, Si, Ca, Zr, Ti, Hf, Zn, Mn, a rare-earth element, Ba, and Sr, preferably the covering layer is made of the oxide, the complex oxide, the nitride, or the carbide, which contains at least one of the same nonmagnetic metals as the nonmagnetic metals that are one of the structural components of the magnetic metallic particle.

In the oxide, the complex oxide, the nitride, and the carbide, more preferably the covering layer is made of the oxide or the complex oxide. Similarly to the oxide and the complex oxide, the effect to improve the high-frequency characteristic is obtained even in the nitride or the carbide. However, preferably the covering layer is made of the oxide or the complex oxide from the viewpoints of the easiness of formation, the oxidation resistance, and the thermal stability of the covering layer. The oxide or complex-oxide covering layer is made of the oxide or the complex oxide, which contains at least one of the magnetic metals that are of the structural components of the magnetic metallic particle, and preferably the oxide or the complex oxide contains at least one nonmagnetic metal selected from the group consisting of Mg, Al, Si, Ca, Zr, Ti, Hf, Zn, Mn, a rare-earth element, Ba, and Sr. As described above, the nonmagnetic metal is the element that is easily oxidized because the oxide thereof has the small standard Gibbs energy of formation, and the nonmagnetic metal easily forms the stable oxide. The oxide covering layer made of the oxide or the complex oxide, which contains at least one nonmagnetic metal, can improve the adhesion/bonding property to the magnetic metallic particle and the thermal stability of the magnetic metallic particle.

In the nonmagnetic metals, the solid solution of Al and Si is easily formed in the Fe, Co, and Ni that are of the main components of the magnetic metallic particle, and Al and Si contribute preferably to the improvement of the thermal stability of the core-shell magnetic particle. The complex oxide containing the plural kinds of the nonmagnetic metals includes the mode of the solid solution.

In the first embodiment, not only the covering layer that covers at least part of the surface of the magnetic metallic particle improves the oxidation resistance of the magnetic metallic particle, but also the covering layer can electrically separate the magnetic particles from one another to enhance the electric resistance of the desired member when the member is prepared by integrating the core-shell magnetic particles covered with the covering layers. The enhancement of the electric resistance of the member can suppress the eddy current loss in the high-frequency range to improve the high-frequency characteristic of the permeability. Therefore, preferably the covering layer has the high electric resistance, for example, a resistance value of 1 mΩ·cm or more.

The covering layer has the thickness of 0.1 nm to 100 nm, preferably the thickness of 0.1 nm to 20 nm. More preferably the covering layer has the thickness of 0.1 nm to 5 nm.

In the case that the thickness of the covering layer is lower than 0.1 nm, the oxidation resistance becomes insufficient, the resistance of the desired member is decreased to easily generate the eddy current loss when the core-shell magnetic particles covered with the covering layers are integrated to prepare the member, and the high-frequency characteristic of the permeability is possibly degraded. On the other hand, in the case that the thickness of the covering layer is more than 100 nm, the filling rate of the magnetic metallic particle included in the member is decreased by the thickness of the covering layer when the core-shell magnetic particles covered with the covering layers are integrated to prepare the desired member, therefore the saturation magnetization of the member may be decreased and the permeability is possibly decreased. The thickness in which the oxidation resistance, the high resistance, and the high permeability hold simultaneously most preferably ranges from 0.1 nm to 5 nm.

(Second Embodiment)

In a core-shell magnetic material according to a second embodiment, the magnetic member of the core-shell magnetic material in the first embodiment further contains the oxide particle, the nitride particle, or the carbide particle, which exists in at least part between the magnetic metallic particles and contains at least one nonmagnetic metal selected from Mg, Al, Si, Ca, Zr, Ti, Hf, Zn, Mn, a rare-earth element, Ba, and Sr. The description overlapping that of the first embodiment is not repeated here.

Figure 2:
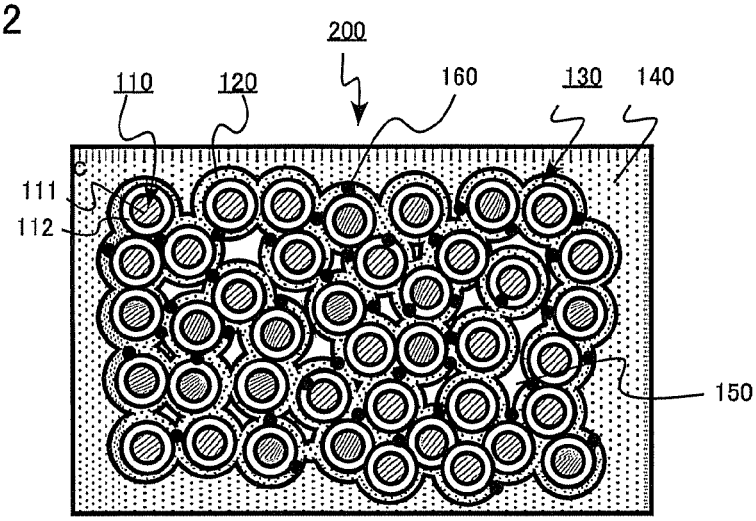
FIG. 2 is a schematic sectional view of a core-shell magnetic material according to a second embodiment.

FIG. 2 is a schematic sectional view of the core-shell magnetic material of the second embodiment. As illustrated in FIG. 2, a core-shell magnetic material 200 includes an oxide particle, a nitride particle or a carbide particle 160 in the magnetic member 130.

The oxide particle, the nitride particle, or the carbide particle 160, which exists in at least part between the magnetic metallic particles 111 in the magnetic member 130, contains at least one nonmagnetic metal. At this point, the particle may be the oxide particle, the nitride particle, or the carbide particle. From the viewpoint of the thermal stability, preferably the particle is the oxide particle (hereinafter the description is made as the oxide particle). As used herein, the existence in at least part between the magnetic metallic particles (cores) means that the oxide particle exists between the cores while being in direct contact with the core or that the oxide particle exists between the cores while being in contact with the shell.

In the preferable state of being of the oxide particle, the oxide particles are uniformly and homogeneously dispersed among the magnetic metallic particles. Therefore, the uniform magnetic characteristic and dielectric characteristic can be expected when the whole of the core-shell magnetic material is viewed.

Similarly to the covering layer, not only the oxide particle improves the oxidation resistance and an aggregation suppressing force of the magnetic metallic particle, namely, the thermal stability of the magnetic metallic particle, but also the oxide particle can electrically separate the magnetic particles from one another to enhance the electric resistance of the desired member when the member is prepared by integrating the core-shell magnetic particles covered with the covering layers. The enhancement of the electric resistance of the member can suppress the eddy current loss in the high-frequency range to improve the high-frequency characteristic of the permeability. Therefore, preferably the oxide particle has the high electric resistance, for example, the resistance value of 1 mΩ×cm or more.

The oxide particle contains at least one nonmagnetic metal selected from the group consisting of Mg, Al, Si, Ca, Zr, Ti, Hf, Zn, Mn, a rare-earth element, Ba, and Sr. As described above, the nonmagnetic metal is the element that is easily oxidized because the oxide thereof has the small standard Gibbs energy of formation, and the nonmagnetic metal easily forms the stable oxide. A ratio of nonmagnetic metal/magnetic metal (atomic ratio) in the oxide particle is larger than a ratio of nonmagnetic metal/magnetic metal (atomic ratio) in the oxide covering layer. Because of the high ratio of the nonmagnetic metal, the oxide particle is thermally stable compared with the oxide covering layer. Therefore, when the oxide particles exist in at least part among the magnetic metallic particles, the electric insulating property between the magnetic metallic particles can further be improved, and the thermal stability of the magnetic metallic particle can also be improved.

It is not necessary that the oxide particle contain the magnetic metal. Preferably the oxide particle may slightly contain the magnetic metal. As to an amount of contained magnetic metal, the magnetic metal is 0.001 at % or more with respect to the nonmagnetic metal, preferably the magnetic metal is 0.01 at % or more. When the oxide particle does not contain any magnetic metal, it is not preferable that the structural components of the oxide particle and the covering layer that covers the surface of the magnetic metallic particle differ completely from each other from the viewpoints of the adhesion and the strength, and sometimes the thermal stability is possibly degraded.

Preferably the oxide particle contains at least one magnetic metal, which is of the structural component of the magnetic metallic particle and the structural component of the oxide covering layer, and more preferably the ratio of nonmagnetic metal/magnetic metal (atomic ratio) in the oxide particle is larger than the ratio of nonmagnetic metal/magnetic metal (atomic ratio) in the oxide covering layer.

The thermal stability improving effect, the electric insulating effect, and the adhesion/strength improving effect of the oxide particle are particularly exerted when the magnetic metallic particle has the small average particle diameter. The effects are exerted when the average particle diameter of the magnetic metallic particle ranges from 1 nm to 1000 nm, preferably ranges from 1 nm to 100 nm, more preferably ranges from 10 nm to 30 nm.

Preferably the oxide particle contains the same element as the nonmagnetic metal contained in the magnetic metallic particle, namely, the oxide particle contains the same element as the nonmagnetic metal contained in oxide covering layer. This is because the thermal stability of the magnetic metallic particle is improved by the oxide particle containing the same element as the nonmagnetic metal.

For example, the composition analysis of the oxide particle can be performed by the methods such as the ICP emission analysis, the TEM-EDX, the XPS, and the SIMS. In the TEM-EDX, the beam of EDX is focused, and the oxide particle is irradiated with the EDX to perform the semi-quantitative analysis, which allows the composition of the oxide particle to be roughly confirmed.

Preferably the average particle diameter of the oxide particle ranges from 1 nm to 100 nm, and the particle diameter of the oxide particle is smaller than the particle diameter of the magnetic metallic particle. More preferably the average particle diameter of the oxide particle ranges from 1 nm to 30 nm. When the average particle diameter is 1 nm or less, the electric insulating property between the magnetic metallic particles and the thermal stability of the magnetic metallic particle are insufficient. When the average particle diameter is 100 nm or more, the ratio of the oxide particle contained in the whole core-shell magnetic material is increased, namely, the ratio of the magnetic metallic particle contained in the whole core-shell magnetic material is decreased, the saturation magnetization of the member is decreased, and therefore possibly the permeability is decreased. Similarly, when the particle diameter of the oxide particle is larger than the particle diameter of the magnetic metallic particle, the saturation magnetization of the member is decreased, and therefore possibly the permeability is decreased. Therefore, preferably the average particle diameter of the oxide particle ranges from 1 nm to 100 nm, and more preferably the average particle diameter of the oxide particle ranges from 1 nm to 30 nm and the particle diameter of the oxide particle is smaller than the particle diameter of the magnetic metallic particle.

In order to obtain the high-frequency-characteristic improving effect of the core-shell magnetic material by the oxide particle, it is necessary that many oxide particles exist among the magnetic metallic particles in the core-shell magnetic material. The number of oxide particles depends on the particle diameters of the magnetic metallic particle and the oxide particle. As a guide, the number of oxide particle is more than 1% of the number of core-shell magnetic particles, preferably more than 10%. When the number of oxide particles is excessively increased compared with the number of core-shell magnetic particles, the saturation magnetization is decreased by the decrease of the number of magnetic metallic particles, and therefore the permeability is decreased. Therefore, as a guide, preferably the number of oxide particles is lower than 200% of the number of core-shell magnetic particles. However, the number of oxide particles is described only as a guide, and the number of oxide particles slightly depends on the particle diameters of the magnetic metallic particle and the oxide particle. As described above, the particle diameter of the oxide particle is preferably smaller than the particle diameter of the magnetic metallic particle. However, the number of oxide particles may be decreased in the case that the ratio of the two particle diameters, namely, (particle diameter of oxide particle)/(particle diameter of magnetic metallic particle) is relatively large, and preferably the number of oxide particles is increased in the case that (particle diameter of oxide particle)/(particle diameter of magnetic metallic particle) is relatively small.

When the ratio of the oxide particle is estimated per volume, preferably the oxide particle ranges from 0.001 vol % to 30 vol % with respect to the total volume of the magnetic metallic particle and the oxide particle. More preferably the oxide particle ranges from 0.01 vol % to 30 vol % with respect to the total volume of the magnetic metallic particle and the oxide particle. The thermal stability and the electric insulating property of the core-shell magnetic material become insufficient when the ratio of the oxide particle is 0.001 vol % or less, and possibly the saturation magnetization is decreased when the ratio of the oxide particle is 30 vol % or more. In order to simultaneously satisfy the high thermal stability, the high electric insulating property, and the high saturation magnetization, the ratio of the oxide particle ranges from 0.001 vol % to 30 vol %, preferably ranges from 0.01 vol % to 30 vol %.

The oxide particle can be determined by the TEM-EDX analysis, and the ratio of the oxide particle can be fixed by counting the number of oxide particles in the TEM analysis image. The volume ratio (a volume ratio of the oxide particle to a total volume of the oxide particle and the magnetic metallic particle) of the oxide particle can simply be calculated from the average particle diameters of the oxide particle and the magnetic metallic particle and the ratio of the numbers of oxide particles and magnetic metallic particles.

Preferably the total volume ratio ("the volume in which the total amount of the nonmagnetic metal, in which the nonmagnetic metal contained in the oxide particle and the nonmagnetic metal contained in the oxide covering layer are added, is converted into oxide"/"the total volume of the magnetic metallic particle having the oxide particle and the oxide covering layer") of the nonmagnetic metal oxides contained in the oxide particle and the oxide covering layer ranges from 0.001 vol % to 90 vol %. More preferably the total volume ratio of the nonmagnetic metal oxides ranges from 0.01 vol % to 30 vol %.

As described above, both the oxide particle containing the nonmagnetic metal and the oxide covering layer containing the nonmagnetic metal have the effect to improve the thermal stability and the electric insulating property of the core-shell magnetic material. However, when the oxide particle or the oxide covering layer is excessively contained, the saturation magnetization is decreased, and therefore the permeability is decreased. In order to simultaneously satisfy the high thermal stability, the high electric insulating property, and the high saturation magnetization, the "total volume ratio of the nonmagnetic metal oxides contained in the oxide particle and the oxide covering layer" ranges from 0.001 vol % to 90 vol %, preferably ranges from 0.01 vol % to 30 vol %.

The "total volume ratio of the nonmagnetic metal oxides contained in the oxide particle and the oxide covering layer" can simply be estimated in the following procedure by the measurement with a VSM (Vibrating Sample Magnetometer). The saturation magnetization per weight of the sample is measured. At this point, when the sample includes the material such as the resin except the core-shell magnetic particle and the oxide particle, the saturation magnetization per weight is calculated while the material except the core-shell magnetic particle and the oxide particle is excluded. Then the ratio of the nonmagnetic metal to the whole sample (when the sample includes the material except the core-shell magnetic particle and the oxide particle, the material except the core-shell magnetic particle and the oxide particle is excluded) is measured by the ICP emission analysis. Assuming simply that the core-shell magnetic particle and the oxide particle are made of the magnetic metal, the magnetic metal oxide, and the nonmagnetic metal oxide, the volume ratios of the magnetic metal, the magnetic metal oxide, and the nonmagnetic metal oxide are calculated so as to match with the measured value of the saturation magnetization.

For example, it is assumed that the magnetic metal is $Fe_{70}Co_{30}$, it is assumed that 5 wt % of Al that is of the nonmagnetic metal is contained in total with respect to the magnetic metal, and it is assumed that the saturation magnetization is 190 emu/g. Assuming that the magnetic metal oxide becomes the oxide of $(Fe, Co)_3O_4$, $Fe_{70}Co_{30}$ is about 60 vol %, the magnetic metal oxide is about 26 vol %, and $Al_2O_3$ is about 14 vol %. Assuming that the magnetic metal oxide becomes the oxide of (Fe, Co)O, $Fe_{70}Co_{30}$ is about 69 vol %, the magnetic metal oxide is about 16 vol %, and $Al_2O_3$ is about 15 vol %. Assuming that the magnetic metal oxide becomes the oxide of $(Fe, Co)_2O_3$, $Fe_{70}Co_{30}$ is about 68 vol %, the magnetic metal oxide is about 18 vol %, and $Al_2O_3$ is about 14 vol %.

As to the parameters used in the above calculations, $Fe_{70}Co_{30}$ has density of 8.08 g/cm$^3$, volume saturation magnetization of 2.46 T, and mass saturation magnetization of 242.3 emu/g, $(Fe, Co)O_3$ has the density of 5.44 g/cm$^3$, the volume saturation magnetization of 0.6 T, and the mass saturation magnetization of 87.7 emu/g, (Fe, Co)O has the density of 6.11 g/cm$^3$, the volume saturation magnetization of 0 T, and the mass saturation magnetization of 0 emu/g, $(Fe, Co)_2O_3$ has the density of 5.24 g/cm$^3$, the volume saturation magnetization of 0 T, and the mass saturation magnetization of 0 emu/g, and $Al_2O_3$ has the density of 3.96 g/cm$^3$, the volume saturation magnetization of 0 T, and the mass saturation magnetization of 0 emu/g. As can be seen from the above calculation results, although the amount of nonmagnetic metal oxide of $Al_2O_3$ depends on what oxide is contained in the magnetic metal oxide, the amount of nonmagnetic metal oxide of $Al_2O_3$ can be estimated to be 14 vol % to 15 vol %. As described above, the "total volume ratio of the nonmagnetic metal oxides contained in the oxide particle and the oxide covering layer" can simply be estimated by the measurement with the VSM.

In the second embodiment, in order to achieve the better characteristics, preferably the composition and the thickness of the oxide covering layer and the composition and the particle diameter of the oxide particle are uniformly formed as much as possible.

In the core-shell magnetic material of the second embodiment, the magnetic metallic particle, which contains at least one magnetic metal selected from the group of Fe, Co, and Ni and at least one element selected from the nonmagnetic metal, the carbon, and the nitrogen, has the high saturation magnetization and a properly-high anisotropy magnetic field. The oxide covering layer, which covers the surface of the magnetic metallic particle and is made of the oxide containing at least one nonmagnetic metal that is one of the structural component of the magnetic metallic particle, and the oxide particle that exists at least part between the magnetic metallic particles have the high insulating property. As a result, the surface of the magnetic metallic particle having the high saturation magnetization and the properly-high anisotropy magnetic field is covered with the oxide covering layer having the high insulating property, and the oxide particle exists between the magnetic metallic particles, so that the core-shell magnetic particle having the properly-high anisotropy magnetic field can be obtained while the eddy current loss that causes the loss at high frequencies can be suppressed.

(Third Embodiment)

A core-shell magnetic material according to a third embodiment differs from that of the first embodiment in that the core-shell magnetic material of the third embodiment includes a polymer compound in at least part of the surface of the core-shell magnetic particle, and the polymer compound contains at least an oxyethylene unit and an amino group in a molecular chain. The description overlapping that of the first embodiment is omitted.

Figure 3:
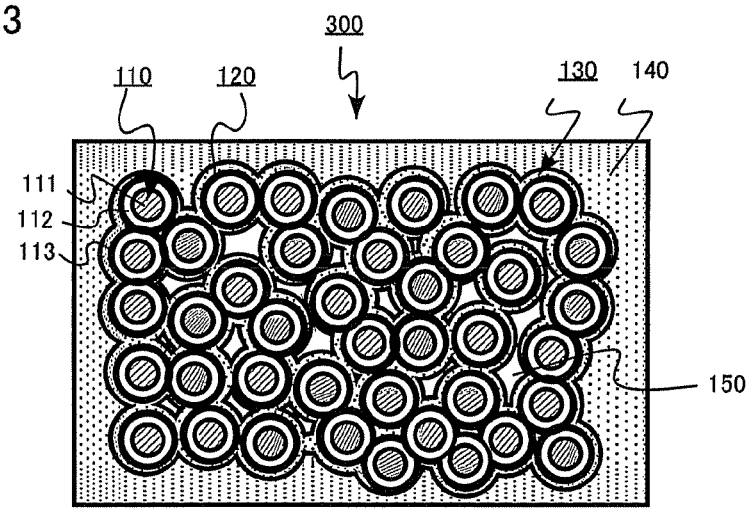
FIG. 3 is a schematic sectional view of a core-shell magnetic material according to a third embodiment.

FIG. 3 is a schematic sectional view of the core-shell magnetic material of the third embodiment. As illustrated in FIG. 3, in a core-shell magnetic material 300, a polymer compound 113 exists in the surface of the core-shell magnetic material 110 while covering, being adsorbed to, or being bonded to the surface of the core-shell magnetic particle 110.

The polymer compound 113 includes the oxyethylene unit and the amino group therein. Specifically, preferably the polymer compound 113 is a tertiary amine polymer compound. Solsperse 20000 (product of Lubrizol) can be cited as an example of the commercially available tertiary amine polymer compound. The core-shell magnetic particle is covered with the polymer compound, or the polymer compound is bonded to part of the core-shell magnetic particle covered with the inorganic covering layer, which allows the aggregation of the core-shell magnetic particles to be prevented in the composite material. Therefore, dispersibility of the core-shell magnetic particle can be improved.

The oxidation of the core metal can further be suppressed by the polymer compound that covers the surface of the magnetic metallic particle. In the particle having the core-shell structure in which the polymer compound having the oxyethylene unit and the amino group is not bonded, for example, in the case of the magnetic material of the first embodiment in which the polymer compound is not provided in the surface of the core-shell magnetic particle, sometimes the oxidation of the particle is generated in a dispersion treatment in which the first resin is used and a subsequent film forming process. Although the process of the oxidation is unclear, it is conceivable that the shell is partially collapsed in the dispersion treatment or it is conceivable that originally the core is insufficiently covered with the shell. It is conceivable that the particle reacts with the oxygen or moisture, which is dissolved or contained in the solvent or the binder resin particle.

According to the third embodiment, the oxidation of the core metal can further be suppressed compared with the first embodiment.

In the case that the core-shell particles are dispersed in an organic solvent, the dispersant is effectively added in order to successfully perform the treatment to disperse the particles. Conventionally, an olenic acid or an oleylamine is used as the dispersant in order to disperse the core-shell magnetic particles. Preferably the dispersant having the low oxygen permeability is used to suppress the oxidation.

Usually the oxygen permeability of the polymer compound depends on a molecular structure. It is well known that a contribution of an atomic group contained in the polymer to the oxygen permeability is determined by a coefficient called a permachor value (M. Salame, Polym. Eng. Sci., 26, 1543 (1986)). Examples of the atomic group having the high permachor value includes a hydroxyl group, an ether bond, an ester bond, and an amide bond. Among others, in consideration of the function as the polymer dispersant, the dispersant containing many ether bonds has the low oxygen permeability. It is also necessary that the dispersant be bonded to the core-shell magnetic particle. Therefore, the dispersant containing the amino group can enhance the function thereof.

Preferably 2 parts by weight to 30 parts by weight of the polymer compound that becomes the dispersant are added to the core-shell magnetic particle during the dispersion treatment. When the amount of dispersant is lower than 2 parts by weight, the dispersion is insufficiently performed to significantly generate the aggregation, or the oxidation is insufficiently suppressed. When the amount of dispersant is more than 30 parts by weight, the resin amount is excessively increased in the finally-obtained magnetic material, the filling rate becomes insufficient in the metallic portion, and therefore the characteristics such as the permeability are decreased.

In the core-shell magnetic material that includes the polymer compound containing at least the oxyethylene unit and the amino group in the molecular chain in at least part of the surface of the core-shell magnetic particle, the oxidation of the core-shell magnetic particle can be suppressed while the dispersibility of the core-shell magnetic particle is successfully maintained.

(Fourth Embodiment)

In a core-shell magnetic material according to a fourth embodiment, the first resin in the core-shell magnetic material of the first or second embodiment includes a polymer compound containing at least the oxyethylene unit and the amino group in the molecular chain. The description overlapping that of the first embodiment is not repeated here.

Similarly to the third embodiment, the core-shell magnetic material of the fourth embodiment includes the polymer compound containing at least the oxyethylene unit and the amino group in the molecular chain in at least part of the surface of the core-shell magnetic particle, so that the oxidation of the core-shell magnetic particle can be suppressed while the dispersibility of the core-shell magnetic particle is successfully maintained. Because the first resin includes the polymer compound, the simple structure can be made to facilitate the production compared with the third embodiment.

In the core-shell magnetic materials of the first to fourth embodiments, a material texture can be analyzed with a SEM (Scanning Electron Microscopy) and a TEM (Transmission Electron Microscopy), the diffraction pattern (including the confirmation of the solid solution) can be analyzed by TEM diffraction and the XRD (X-ray Diffraction), and identification and a quantitative analysis of the constituent element can be determined by the ICP (Inductively coupled plasma) emission analysis, a fluorescence X-ray analysis, an EPMA (Electron Probe Micro-Analysis), an EDX (Energy Dispersive X-ray Fluorescence Spectrometer), and the SIMS (Secondary Ion Mass Spectrometry). The longest diagonal line and the shortest diagonal line of each particle are averaged as the particle diameter by a TEM observation or a SEM observation, and each of the average particle diameters of the magnetic metallic particle and the oxide particle can be fixed by the average of many particle diameters.

In the case that the average particle diameter of the magnetic metallic particle is hardly fixed by the TEM, the crystal particle diameter obtained from the XRD measurement can be substituted for the average particle diameter. That is, the crystal particle diameter can be obtained from an diffraction angle and a half-value width by a Scherrer formula with respect to the strongest peak in peaks generated by the magnetic metal in the XRD. The Scherrer formula is expressed by $D=0.9\lambda/(\beta \cos \theta)$. Where D is the crystal particle diameter, $\lambda$ is a measured X-ray wavelength, $\beta$ is the half-value width, and $\theta$ is a diffraction Bragg angle. The thickness of the oxide covering layer can be fixed by the TEM observation. The volume ratio of the oxide particle can simply be calculated from the average particle diameters of the oxide particle and the magnetic metallic particle and the ratio of the numbers of oxide particles and magnetic metallic particles. The "total volume ratio of the nonmagnetic metal oxides contained in the oxide particle and the oxide covering layer" can simply be estimated by the saturation magnetization value per mass measured with the VSM and a quantitative value of the nonmagnetic metal fixed by the ICP analysis.

(Fifth Embodiment)

A core-shell magnetic material producing method according to a fifth embodiment includes: a step of producing a magnetic metallic particle made of a magnetic metal and a nonmagnetic metal; a step of forming a core-shell particle by oxidizing, nitriding, or carbonizing the magnetic metallic particle; a step of preparing a kneading matter by mixing the core-shell magnetic particle in liquid containing a first resin; a step of forming a magnetic member by molding the kneading matter; and a step of forming a coating layer by impregnating a surface of the magnetic member with a second resin. The magnetic metal is at least one magnetic metal selected from the group consisting of Fe, Co, and Ni, and the nonmagnetic metal is at least one nonmagnetic metal selected from Mg, Al, Si, Ca, Zr, Ti, Hf, Zn, Mn, a rare-earth element, Ba, and Sr.

Particularly, the fifth embodiment preferably includes the step of covering the surface of the magnetic metallic particle with the carbon and the step of forming a hydrocarbon from the carbon by performing a heat treatment of the magnetic metallic particle covered with the carbon in a reduction atmosphere between the step of producing the magnetic metallic particle and the step of oxidizing, nitriding, or carbonizing the magnetic metallic particle. Preferably the fifth embodiment includes the above steps from the viewpoint of making the finer texture. That is, preferably the particle diameters of the core-shell magnetic particles and the thicknesses of the covering layers of the core-shell magnetic particles can be uniformed and homogenized.

There is no particular limitation to the magnetic metallic particle producing step. Preferably the magnetic metallic particle producing step is performed by a thermal plasma method. The magnetic metallic particle producing method in which the thermal plasma method is adopted will be described below. Argon (Ar) is introduced as a plasma generating gas to a high-frequency induction thermal plasma apparatus to generate plasma. At this point, a raw material of the magnetic metallic particle is sprayed into the plasma with Ar as a carrier gas. There is no particular limitation to an argon inflow amount as the plasma generating gas.

For example, the raw material of the magnetic metallic particle containing the magnetic metal and the nonmagnetic metal may be either a solid solution powder of the magnetic metal and the nonmagnetic metal or a mixture of the solid solution powder of the magnetic metal and the nonmagnetic metal and a nonmagnetic metal powder. In the case of the former, the magnetic material that does not include the oxide particle, the nitride particle, or the carbide particle is formed like the first embodiment. In the case of latter, the magnetic material that includes the oxide particle, the nitride particle, or the carbide particle is formed like the second embodiment.

At this point, the magnetic metal powder or the solid solution powder of at least one magnetic metal selected from the group consisting of Fe, Co, and Ni is used.

The magnetic metallic particle producing step is not limited to the thermal plasma method. However, when the thermal plasma method is adopted, preferably the material texture is easily controlled at a nano level and a large amount of magnetic metallic particle can be synthesized.

Preferably the magnetic metallic particle in which the solid solution of the nitrogen is formed has the high magnetic anisotropy. A method for introducing the nitrogen along with the argon of the plasma generating gas is conceivable in order to form the solid solution of the nitrogen, but the method is not limited thereto.

As to the step of covering the surface of the magnetic metallic particle with the carbon, in the magnetic metallic particle producing step, a hydrocarbon gas such as an acetylene gas or a methane gas is introduced as a carbon covering raw material along with the carrier gas, and the carbon covering is performed by a reaction in which the hydrocarbon gas is used as the raw material. In this method, the carbon covering hydrocarbon gas introduced along with the carrier gas is not limited to the acetylene gas or the methane gas.

Alternatively, it is conceivable to adopt a method for simultaneously spraying the raw material containing the carbon and the raw material of the magnetic metallic particle. In this method, the pure carbon is conceivable, but is not limited to, as the raw material containing the carbon.

Preferably the above two methods are adopted from the viewpoint of covering uniformly and homogeneously the magnetic metallic particle with the carbon. The step of covering the surface of the magnetic metallic particle with the carbon is not limited to the above two methods.

The particle in which the magnetic metallic particle is covered with the carbon is obtained through the step of covering the surface of the magnetic metallic particle with the carbon. Therefore, the magnetic metallic particle can exists uniformly and homogeneously in the carbon covering layer. That is, when the carbon covering is performed, the magnetic metallic particle can uniformly and homogeneously be synthesized in the carbon covering layer, and the finally-produced core-shell magnetic particle is easily uniformed and homogenized through a carbon covering layer removing step and an oxidation step. In the carbon covering step, not only the carbon exists as the covering layer, but also the solid solution of the carbon in the magnetic metallic particle is slightly formed. Therefore, preferably the magnetic anisotropy of the magnetic metallic particle can be improved.

In the step of forming the hydrocarbon from the carbon by performing the heat treatment of the magnetic metallic particle covered with the carbon in the reduction atmosphere, not only the carbon covering layer existing on the surface of the magnetic metallic particle is removed, but also the solid solution of the carbon or the nitrogen is effectively promoted by the heating. Examples of the reduction atmosphere includes a nitrogen or argon atmosphere containing a reducing gas such as hydrogen, a carbon monoxide, and the methane and a nitrogen or argon atmosphere in a state in which surroundings of the heating target is covered with a carbon material. More preferably a hydrogen gas atmosphere having a concentration of 50% or more is used as the reduction atmosphere. This is because carbon covering layer removing efficiency is improved.

Preferably the nitrogen or argon atmosphere containing the reducing gas is formed by a flow current, and a rate of the flow current is 10 mL/min or more. Preferably the heating is performed in the reduction atmosphere at temperatures of 100° C. to 800° C. More preferably the heating is performed at temperatures of 400° C. to 800° C. When the heating temperature is lower than 100° C., possibly progress of a reduction reaction is delayed. On the other hand, when the temperature is more than 800° C., the aggregation and particle growth of the metallic fine particle possibly progress in a short time. There is no particular limitation to a reduction temperature and a reduction time as long as at least the carbon covering layer can be reduced. The reduction time depends on the reduction temperature. For example, the reduction time preferably ranges from 10 minutes to 10 hours.

In the step of oxidizing, nitriding, or carbonizing the magnetic metallic particle, the oxide, nitride, or carbide covering layer that covers the surface of the magnetic metallic particle is produced, and preferably the oxide covering layer is formed as described above from the viewpoints of the easiness of the formation, the oxidation resistance, and the thermal stability of the covering layer. The step in the case that an oxidation treatment is performed will be described below. In the step, a heating treatment of the magnetic metallic particle is performed in the oxidation atmosphere. At least one nonmagnetic metal, which is contained in the magnetic metallic particle and selected from Mg, Al, Si, Ca, Zr, Ti, Hf, Zn, Mn, a rare-earth element, Ba, and Sr, is oxidized by the heating treatment. The nonmagnetic metal is precipitated in the surface of the magnetic metallic particle, thereby forming the oxide covering layer containing the nonmagnetic metal.

There is no particular limitation to the atmosphere used in the oxidation step as long as the oxidizing atmosphere such as oxygen and $CO_2$ is used. In the case of the use of the oxygen, because the oxidation progresses instantaneously to possibly generate the aggregation due to heat generation when the oxygen has the high concentration, preferably the concentration of the oxygen is 5% or less in an inert gas, more preferably ranges from 10 ppm to 3%, but the concentration is not limited thereto. Preferably the heating is performed at a temperature in a range from room temperature to 800° C. When the temperature is more than 800° C., the aggregation and the particle growth of the magnetic metallic particle progress in a short time to possibly degrade the magnetic characteristic. In the oxidation step, the solid solution state of the nonmagnetic metal contained in the magnetic metallic particle or the elements such as the carbon and the nitrogen can be controlled by controlling an oxidation condition. As the oxidation is slowly performed over time, the nonmagnetic metal and the elements such as the carbon and the nitrogen are discharged from the magnetic metal to suppress the formation of the solid solution of the nonmagnetic metal, the carbon, or the nitrogen. On the contrary, when the oxidation is relatively quickly performed in a short time, the solid solution of the nonmagnetic metal and the elements such as the carbon and the nitrogen can be maintained.

The core-shell magnetic particle can be produced by the producing method. The core-shell magnetic particle includes the magnetic metallic particle and the oxide coating layer that covers at least part of the surface of the magnetic metallic particle, the magnetic metallic particle contains at least one magnetic metal selected from the group consisting of Fe, Co, and Ni, at least one nonmagnetic metal selected from Mg, Al, Si, Ca, Zr, Ti, Hf, Zn, Mn, the rare-earth element, Ba, and Sr, and at least one element selected from the carbon and the nitrogen, and the oxide covering layer is made of the oxide containing at least one nonmagnetic metal that is one of the structural component of the magnetic metallic particle.

The produced core-shell magnetic particle is mixed with a liquid substance containing the first resin, thereby producing the kneading matter. Then the kneading matter is molded into the desired shape to form the magnetic member. The liquid substance containing the first resin may be either a solution in which the first resin is dissolved in the solvent or a liquid substance such as the pre-hardening epoxy. For example, by way of example with no limitation, the first resin is dissolved in the organic solvent and mixed in the core-shell magnetic particle, and the mixture is molded by pressing after drying and granulation.

The molded magnetic member is impregnated with the liquid substance containing the second resin, and the solvent is scattered or hardened, which allows the coating layer made of the second resin to be formed in at least the surface of the magnetic member. Preferably, in forming the coating layer, the magnetic member is impregnated with the second resin under reduced pressure. This is because the second resin invades easily into a void portion existing in the magnetic member by performing the impregnation under reduced pressure. Preferably the impregnation is performed in a vacuum from this viewpoint.

In the case that the structure in which the polymer compound is provided at least part of the surface of the core-shell magnetic particle is produced like the core-shell magnetic material of the third embodiment, during the step of producing the kneading matter in which the polymer compound adsorbed to the surface of the core-shell magnetic particle is used, the core-shell magnetic particles and the first resin are mixed in the solvent containing the polymer compound including the oxyethylene unit and the amino group, and the core-shell magnetic particles are dispersed in the organic solvent. At, this point, the core-shell magnetic particles, the polymer compound including the oxyethylene unit and the amino group, and the first resin may simultaneously be mixed in the organic solvent or sequentially be added into the organic solvent. Any organic solvent may be used as long as the polymer compound and the dielectric resin that constitutes the first resin can be dissolved.

Examples of the organic solvents include: ketone solvents such as an acetone, a methyl ethyl ketone, a methyl isobutyl ketone, a y-butyrolactone, and a cyclohexanon; alcohol solvents such as a methanol, an ethanol, and an isopropanol; polar solvents such as an ethylene glycol, a propylene glycol, a propylene glycol monoethyl ether, a diethylene glycol monobuthyl ether acetate, a dimethyl acetamide, and an N-methyl pyrolidone; and hydrocarbon solvents such as a hexane, a cyclohexane, a tetradecane, a toluene, and a xylene. Each of examples of the organic solvents may solely be used or may be used by a combination of at least two kinds of organic solvents.

Preferably the solvent has a vapor pressure of 10 mmHg or more at a temperature of 20° C. When the vapor pressure at the temperature of 20° C. is lower than 10 mmHg, the solvent remains in the material even after slurry is solidified, the reliability of the dielectric characteristic of the material is degraded.

There is no particular limitation to a dispersion method after mixing. Preferably a dispersion treatment by ultrasound and a method, in which kneading machine such as a roll mill, a sand mill, a homogenizer, or a triple roll mill is used, are adopted. Preferably the treatment is performed in the inert gas atmosphere such as argon and nitrogen in order to suppress the oxidation of the particles as little as possible.

As described above, in the case that the polymer compound including the oxyethylene unit and the amino group is used as the first resin, the core-shell magnetic particles are mixed in the solvent containing the polymer compound including the oxyethylene unit and the amino group, and the core-shell magnetic particles are dispersed in the organic solvent. Then, the binder resin that controls the molding is introduced, the molding is performed to the slurried dispersion liquid to form the film. A method for applying the dispersion liquid on the board can be cited as an example of the method for molding the obtained slurry. Specifically, the dispersion liquid is uniformly applied to the board by a doctor blade method, and the dispersion liquid is dried. There is also a method for performing the molding by pressing after the slurry is dried and solidified by a frame. Preferably the method is performed in the inert gas atmosphere such as argon and nitrogen in order to suppress the oxidation of the particles as little as possible.

The solidified molding body is covered with the second resin by performing the impregnation treatment, and the high-frequency magnetic material can be obtained.

The core-shell magnetic material of the first, second, or third embodiment can be produced by the above producing method.

(Sixth Embodiment)

A core-shell magnetic material producing method according to a sixth embodiment is a method for producing the core-shell magnetic material of the fourth embodiment, namely, the core-shell magnetic material in which the first resin contains the polymer compound including at least the oxyethylene unit and the amino group in the molecular chain. The core-shell magnetic material producing method of the sixth embodiment includes: a step of producing the magnetic metallic particle made of the magnetic metal and the nonmagnetic metal; a step of forming the core-shell magnetic particle by oxidizing, nitriding, or carbonizing the magnetic metallic particle; a step of preparing the dispersion liquid in which the core-shell magnetic particles are dispersed in the solvent by mixing the core-shell magnetic particles in the solvent containing the polymer compound including at least the oxyethylene unit and the alkylamino group in the molecular chain and the polymer compound having the main backbone made of the hydrocarbon chain; and a step of forming the film by molding the dispersion liquid, the magnetic metal is at least one magnetic metal selected from the group consisting of Fe, Co, and Ni, and the nonmagnetic metal is at least one nonmagnetic metal selected from Mg, Al, Si, Ca, Zr, Ti, Hf, Zn, Mn, the rare-earth element, Ba, and Sr. The description overlapping that of the fifth embodiment is not repeated here.

In the case of the producing method of the sixth embodiment, the core-shell magnetic particles are mixed in the solvent containing the polymer compound including the oxyethylene unit and the amino group, and the core-shell magnetic particles are dispersed in the organic solvent to generate the dispersion liquid. Then, the second resin that controls the molding is introduced, the molding is performed to the slurried dispersion liquid to form the film. The method for applying the dispersion liquid on the board can be cited as an example of the method for molding the obtained slurry. Specifically, the dispersion liquid is uniformly applied to the board by the doctor blade method, and the dispersion liquid is dried. There is also the method for performing the molding by pressing after the slurry is dried and solidified by the frame. Preferably the method is performed in the inert gas atmosphere such as argon and nitrogen in order to suppress the oxidation of the particles as little as possible.

(Seventh Embodiment)

A device according to a seventh embodiment is a high-frequency device including the core-shell magnetic material of the first, second, third, or fourth embodiment. Accordingly, the description overlapping that of the first embodiment is not repeated here. For example, the device is high-frequency magnetic components such as an inductor, a choke coil, a filter, and a transformer or a radiowave absorber.

The core-shell magnetic material can be subjected to various processes in order to apply the core-shell magnetic material to the device. For example, in the case of a sintered body, mechanical processes such as polishing and grinding are performed. In the case of the powder, the powder is mixed in resins such as the epoxy resin and the polybutadiene. A surface treatment is further performed as needed basis. A winding treatment is performed in the case that the high-frequency magnetic component is the inductor, the choke coil, the filter, and the transformer.

According to the device of the seventh embodiment, the device having the excellent characteristic and the high reliability in the GHz-band can be constructed.

(Eighth Embodiment)

An antenna device according to an eighth embodiment is a antenna device including the core-shell magnetic material of the first, second, third, or fourth embodiment. Accordingly, the description overlapping that of the first, second, third, or fourth embodiment is not repeated here. The antenna device of the eighth embodiment includes a feeding terminal, an antenna element in which the feeding terminal is connected to one end thereof, and the core-shell magnetic material that suppresses a transmission loss of an electromagnetic wave radiated from the antenna element.

Figure 4:
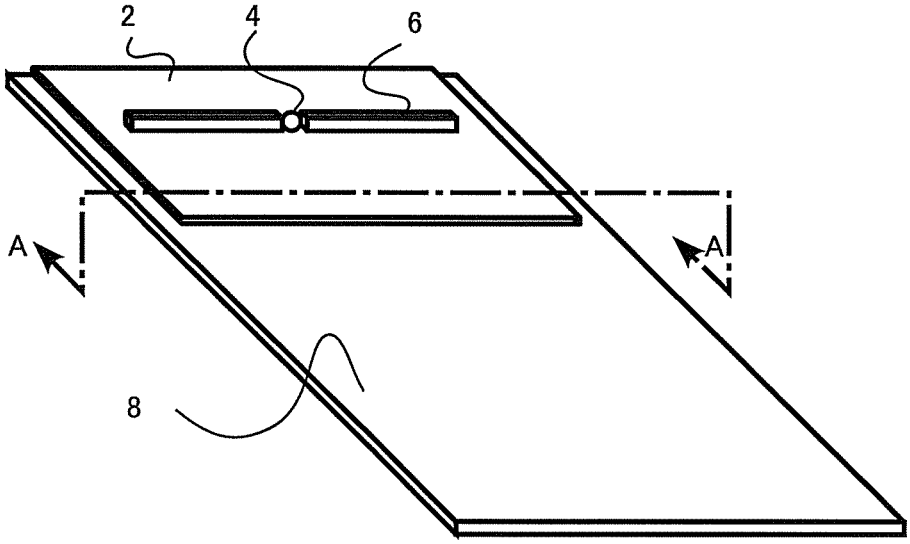
FIG. 4 is a configuration diagram of an antenna device according to an eighth embodiment.
Figure 4:
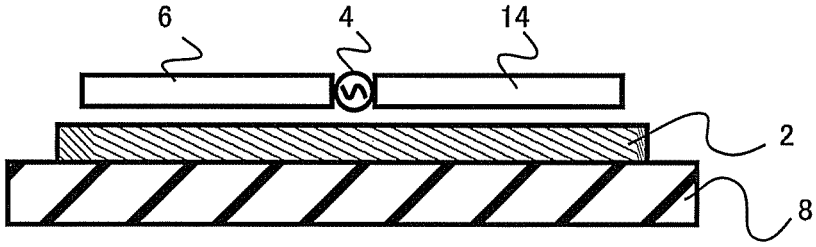

FIG. 4 is a configuration diagram of the antenna device of the eighth embodiment. FIG. 4(*a*) is a perspective view, and FIG. 4(*b*) is a sectional view taken on a line A-A of FIG. 4(*a*). A core-shell magnetic material 2 is provided between an antenna element 6 in which a feeding terminal 4 is connected to one end of the antenna element 6 and a wiring board 8. For example, the wiring board 8 is a wiring board for a mobile device, and the wiring board 8 is surrounded by a metallic chassis.

For example, in the case that the antenna of the mobile device radiates the electromagnetic wave, when the antenna and a metal such as the chassis of the mobile device come close to each other above a certain level, the radiation of the electromagnetic wave is obstructed by an induction current generated in the metal. When the core-shell magnetic material is disposed near the antenna, the induction current is not generated even if the antenna and the metal such as the chassis are brought close to each other, radio communication can stably be conducted and the mobile device can be miniaturized.

In the eighth embodiment, the core-shell magnetic material 2 is inserted between the two antenna elements 6 disposed opposite each other across the feeding terminal 4 and the wiring board 8. Therefore, when the antenna element 6 radiates the electromagnetic wave, the induction current generated in the wiring board 8 can be suppressed to increase radiation efficiency of the antenna device.

(Ninth Embodiment)

An antenna device according to a ninth embodiment includes: a finite ground plane; a rectangular conductor plate that is provided above the finite ground plane, one side of the rectangular conductor plate being connected to the finite ground plane, the rectangular conductor plate including a bent portion substantially parallel to the one side; an antenna that is disposed above the finite ground plane in substantially parallel with the finite ground plane, the antenna extending in a direction substantially perpendicular to the one side, a feeding point of the antenna being located near the other side disposed opposite the one side of the rectangular conductor plate; and a magnetic body that is provided in at least part of a space between the finite ground plane and the antenna. The magnetic body is the core-shell magnetic material of the first, second, third, or fourth embodiment. Accordingly, the description overlapping that of the first, second, third, or fourth embodiment is not repeated here.

As used herein, "above" means only a positional relationship based on the case in which the finite ground plane is located below, and "above" does not express that the antenna is always located above in a vertical direction. Additionally, it is assumed that "above" is a concept including the case in which two elements are in contact with each other.

Figure 5:
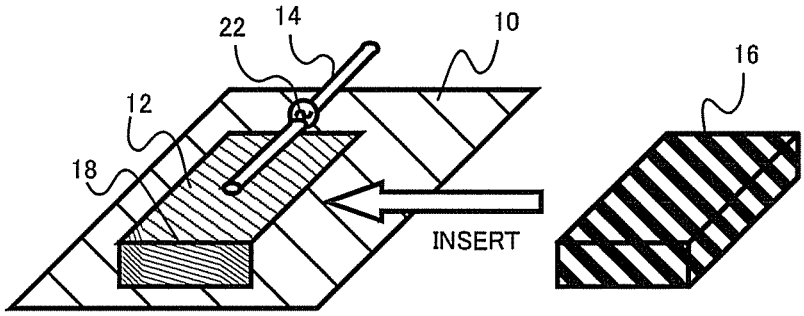
FIG. 5 is a configuration diagram of an antenna device according to a ninth embodiment.
Figure 5:
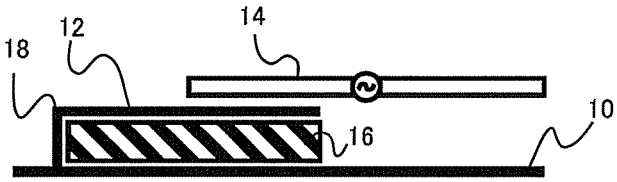
Figure 5:
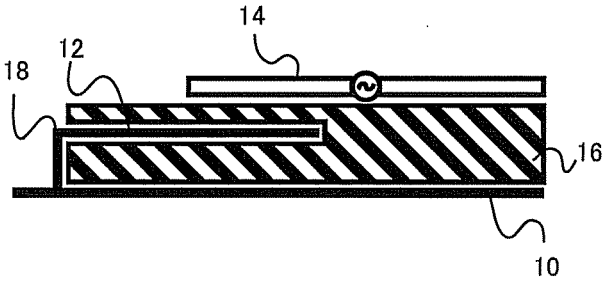

FIG. 5 is a configuration diagram of the antenna device of the ninth embodiment. FIG. 5(*a*) is a perspective view, FIG. 5(*b*) is a sectional view, and FIG. 5(*c*) is a sectional view of a modification.

The antenna device includes a finite ground plane 10, a rectangular conductor plate 12 that is provided above the finite ground plane 10, an antenna 14 that is disposed above the finite ground plane 10 in substantially parallel with the finite ground plane 10, and a magnetic body 16 that is provided in at least part of a space between the finite ground plane 10 and the antenna 14. Referring to FIG. 2, the magnetic body 16 is inserted between the finite ground plane 10 and the rectangular conductor plate 12. In FIG. 5(*a*), the magnetic body 16 is separated from the antenna device for the purpose of easy understanding of the configuration of the antenna device.

In FIG. 5(*b*), spaces are provided among the magnetic body 16, the finite ground plane 10, and the rectangular conductor plate 12. However, in order to enhance the effect to insert the magnetic body 16, preferably the spaces are removed to bring the magnetic body 16, the finite ground plane 10, and the rectangular conductor plate 12 into contact with one another. In FIG. 5(*b*), the magnetic body 16 is inserted only between the rectangular conductor plate 12 and the finite ground plane. However, as illustrated in a modification of FIG. 5(*c*), the magnetic body 16 may be inserted to the antenna 14 while spreading out of the rectangular conductor plate 12, or the magnetic body 16 may be inserted between the antenna 14 and the rectangular conductor plate 12.

From the viewpoint of the adhesion between the magnetic body 16 and the finite ground plane 10, the rectangular conductor plate 12, and the antenna 14, sometimes necessity to interpose other materials in spaces between the magnetic body 16 and the finite ground plane 10, the rectangular conductor plate 12, and the antenna 14 is generated. In such cases, in the spaces between the finite ground plane 10 and the antenna 14, preferably the spaces except the space occupied by the magnetic body is occupied by the dielectric body, and a combination of the dielectric body and the magnetic body, in which refractive indexes are equal to each other, is selected.

This is attributed to the following facts. That is, in the case of the single magnetic body or the combination of the dielectric body and the magnetic body, in which the refractive indexes differ from each other, the radiowave is reflected at an interface between the magnetic body and air or an interface between the magnetic body and the dielectric body. The radiation efficiency of the antenna device is degraded in the case that the loss is generated in the magnetic body or the dielectric body, and the band is narrowed even if the loss is not generated. When the refractive index in the space is kept constant, the unnecessary reflection of the radiowave can be suppressed and the degradation of the radiation efficiency can be suppressed.

Both the finite ground plane 10 and the rectangular conductor plate 12 are made of a conductive material. One side of the rectangular conductor plate 12 is connected to the finite ground plane 10, whereby the rectangular conductor plate 12 is electrically short-circuited. The rectangular conductor plate 12 includes a bent portion 18 substantially parallel to the one side thereof. The antenna 14 is provided above the rectangular conductor plate 12, and the antenna 14 extends in a direction substantially perpendicular to the one side in which the rectangular conductor plate 12 is in contact with the finite ground plane 10. A feeding point 22 of the antenna 14 is located near the other side opposite one side in the rectangular conductor plate 12. In FIG. 5, the antenna 14 is a dipole antenna.

The bent portion 18 of the rectangular conductor plate 12 may be formed by folding the rectangular conductor plate. Alternatively, instead of folding the rectangular conductor plate, two rectangular conductor plates are prepared as long as the rectangular conductor plates are electrically equivalent to each other, and the rectangular conductor plates may physically and electrically be connected by a method such as soldering. In the antenna device of FIG. 2, the bent portion 18 of the rectangular conductor plate 12 is folded at right angles, and includes a portion parallel to the finite ground plane 10 and a portion perpendicular to the finite ground plane 10. However, the bent portion 18 is not limited to the above structure as long as the electromagnetic wave can be propagated below the rectangular conductor plate 10. That is, it is not always necessary to fold the rectangular conductor plate 12 at right angles, and it is not always necessary to provide the portion parallel or perpendicular to the finite ground plane 10.

"The feeding point 22 of the antenna 14 is located near the other side opposite one side in the rectangular conductor plate 12" means that the feeding point 22 is located within a range of one-sixth or less of the wavelength of the electromagnetic wave at an operating frequency of the antenna 14 from the other side. As described later, the reason the feeding point 22 is located within the range is that the position of the feeding point 22 is adjusted in order to perform antenna matching.

FIG. 5 illustrates the case in which the antenna 14 is the dipole antenna. In the dipole antenna of FIG. 5, the power feeding is performed between the two linear conductors while the two linear conductors are arrayed in line.

Figure 6:
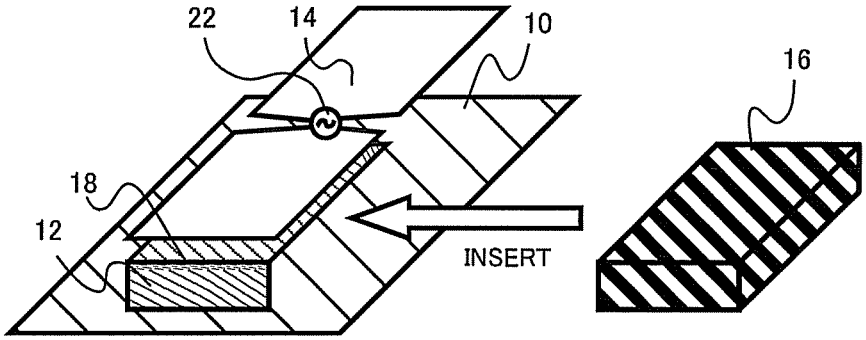
FIG. 6 is a configuration diagram of an antenna device according to a first modification of the ninth embodiment.

FIG. 6 is a configuration diagram of an antenna device according to a first modification of the ninth embodiment. In the first modification, a plate-like dipole antenna is used as the antenna 14. In the plate-like dipole antenna, the power feeding is performed in the center while two conductor plates are arrayed, and a side of the conductor plate, located closer to the feeding point 22, is obliquely cut such that a spacing between the two conductor plates are increased with distance from the feeding point. The plate-like dipole antenna has an advantage that a broadband characteristic can be obtained compared with the dipole antenna in which the linear conductor is used.

Figure 7:
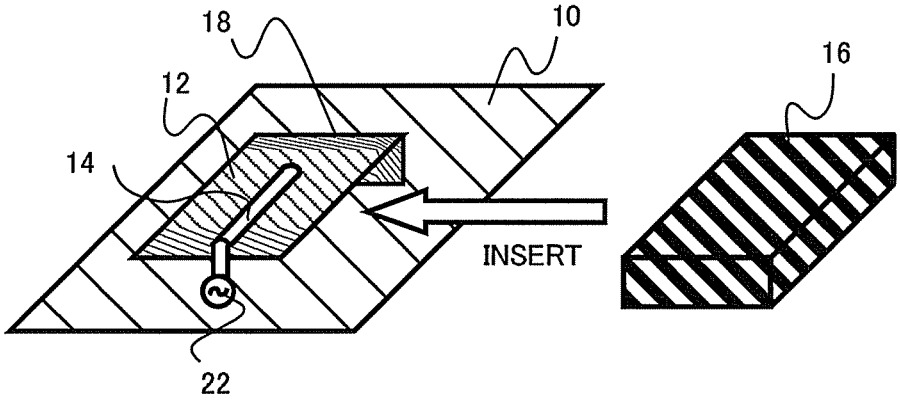
FIG. 7 is a configuration diagram of an antenna device according to a second modification of the ninth embodiment.
Figure 7:
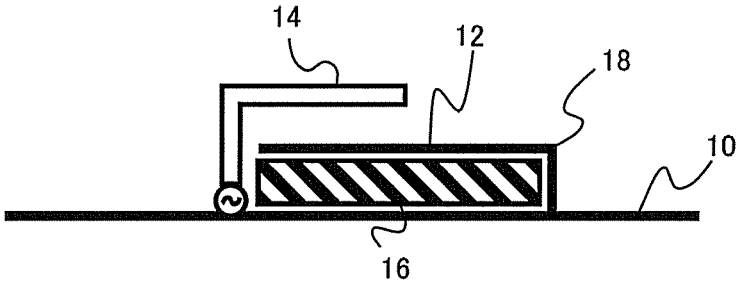
Figure 7:
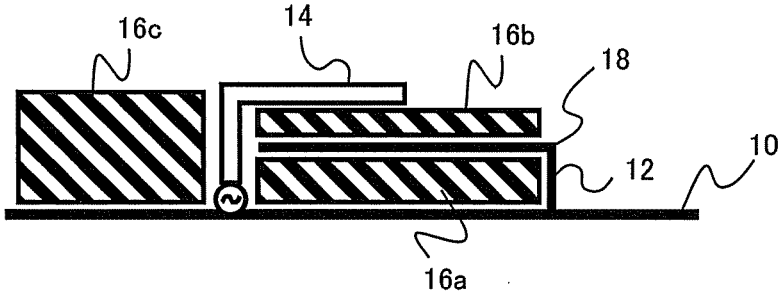

FIG. 7 is a configuration diagram of an antenna device according to a second modification of the ninth embodiment. FIG. 7(*a*) is a perspective view, FIG. 7(*b*) is a sectional view, and FIG. 7(*c*) is a modification of the second modification. In the second modification, a monopole antenna is used as the antenna 14. In the monopole antenna, compared with the dipole antenna of FIG. 5, the linear conductor located on the farther side of the rectangular conductor plate 12 is eliminated, and the side of the feeding point 22 is folded such that the feeding point 22 is located on the finite ground plane 10. The monopole antenna is preferable to the dipole antenna in order to further achieve the miniaturization of the antenna device.

As illustrated in FIGS. 5(*a*) and 5(*b*), FIG. 6, and FIGS. 7(*a*) and 7(*b*), the magnetic body 16 is inserted in at least part between the antenna 14 and the rectangular conductor plate 12, for example, between the rectangular conductor plate 12 and the finite ground plane 10.

According to the above configuration, in the antenna device of the ninth embodiment, even if the low-profile antenna device is constructed, the impedance matching can be performed and the broadband characteristic can be obtained.

(Tenth Embodiment)

An antenna device according to a tenth embodiment is a mobile device which includes a wiring board, a spiral antenna element that is connected to the feeding terminal provided in the wiring board, and a magnetic body that is provided inside the spiral antenna element. The magnetic body is the core-shell magnetic material of the first, second, third, or fourth embodiment. Accordingly, the description overlapping that of the first, second, third, or fourth embodiment is not repeated here.

Figure 8:
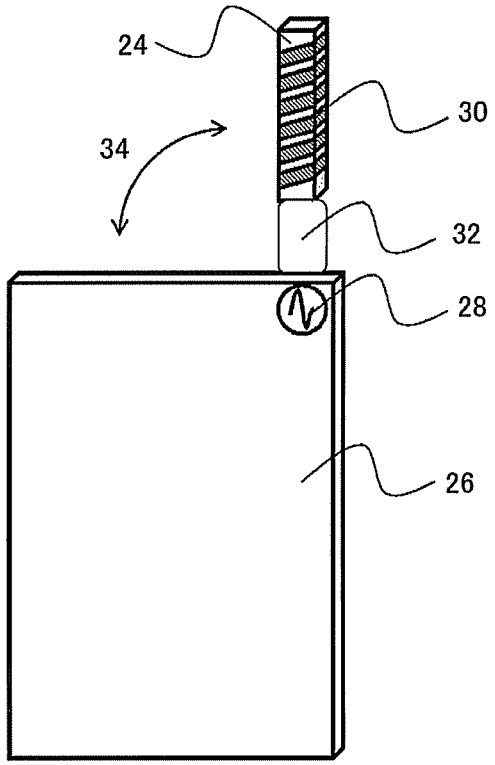
FIG. 8 is a configuration diagram of an antenna device according to a tenth embodiment.

FIG. 8 is a configuration diagram of the antenna device of the tenth embodiment. A core-shell magnetic material 24 is provided inside a spiral antenna element 30, and the spiral antenna element 30 is connected to a wiring board 26 through an antenna feeding terminal 28 provided in the wiring board and an antenna movable portion 32. For example, the wiring board 26 is one on which a wireless circuit (not illustrated) of the mobile device is mounted, and the wiring board 26 is surrounded by a chassis made of a nonconductive resin such as an ABS and a PC (polycarbonate). It is conceivable that the antenna movable portion 32 can be moved at 90 degrees in a movable direction 34, drawn from the wiring board 26, or moved at 360 degrees.

Figure 9:
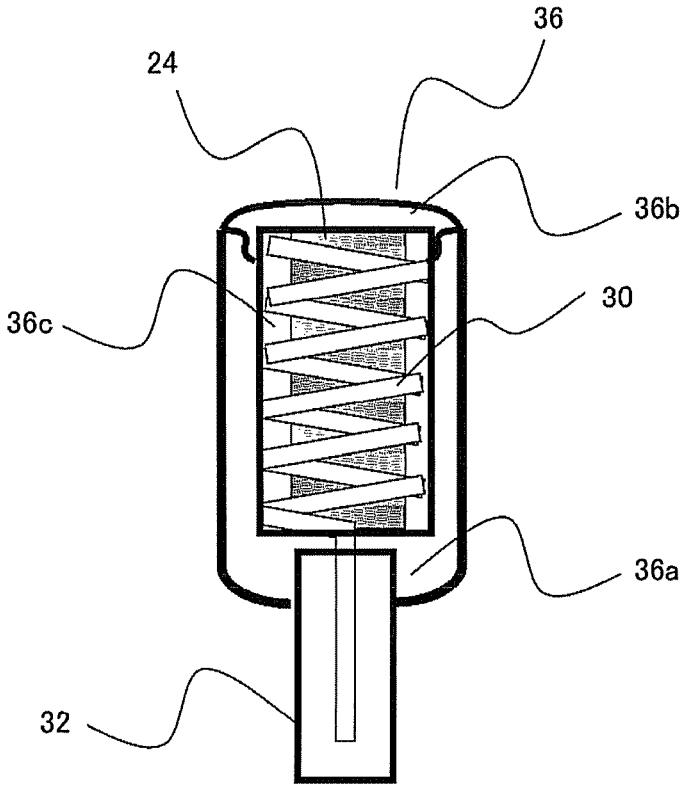
FIG. 9 is an explanatory view of the detailed antenna device of the tenth embodiment.

FIG. 9 is an explanatory view of the detailed antenna device of the tenth embodiment. An antenna cover 36 is made of a nonconductive resin, and includes a box portion 36*a* and a cap portion 36*b*. The antenna movable portion 32 is inserted in the box portion 36*a*, and the spiral antenna element 30 is provided in the box portion 36*a*. The antenna movable portion 32 and the spiral antenna element 30 are electrically connected. At this point, the cap portion 36*b* is connected to the box portion 36*a* by welding or using a bonding agent, thereby forming the antenna cover 36. The core-shell magnetic material 24 is provided in a cavity 36*c* in the spiral element 30.

An operating principle of the tenth embodiment will be described. Because the antenna element 30 is formed into the spiral shape, not only an antenna length can be increased in a small area, but also an inductance component is increased. Therefore, the antenna element 30 is affected by the permeability rather than the permittivity. When the core-shell magnetic material 24 is provided in the spiral antenna element 30, the antenna element 30 is hardly affected by the permittivity even if the permittivity, particularly a loss component is relatively large, and the antenna element 30 is affected by the permeability. Therefore, the decrease in radiation efficiency is reduced by a material having the small loss component, namely, a small imaginary part of complex specific magnetic permeability, and effect of the miniaturization can be expected by a real part of the complex specific magnetic permeability.

According to the tenth embodiment, because the core-shell magnetic material 24 is disposed inside the spiral antenna element 30, the antenna element 30 can be miniaturized, and the intensive loss generated in the circuit portion can be reduced compared with the case that a lumped-constant circuit is used. Therefore, the radiation efficiency of the antenna device can be increased.

(Eleventh Embodiment)

An antenna device according to an eleventh embodiment includes an antenna element that is formed around the core-shell magnetic material of the first, second, third, or fourth embodiment. According to the eleventh embodiment, the compact, high-efficiency, high-reliability antenna is provided.

Figure 10:
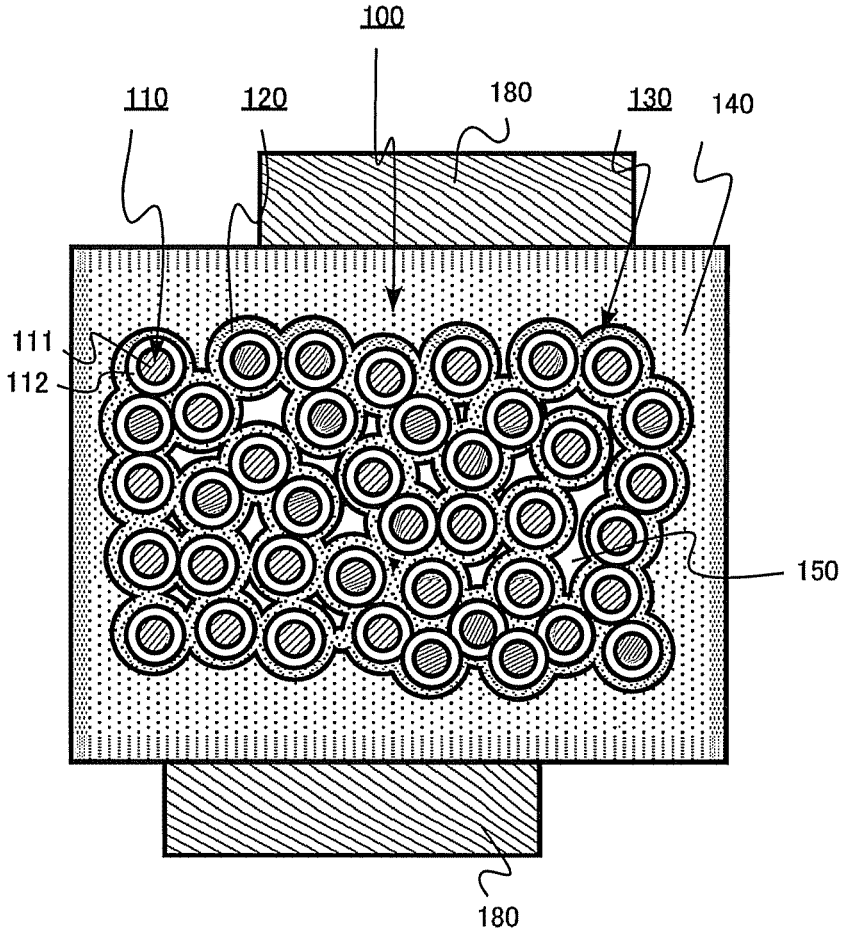
FIG. 10 is an explanatory view of a detailed antenna device according to an eleventh embodiment.

FIG. 10 is a sectional view illustrating a configuration of the antenna device of the eleventh embodiment. FIG. 10 illustrates a section of a main part of the antenna device. The antenna device includes an antenna element 180 that is formed in the surface of the second resin 140, and the second resin 140 covers the surface of the core-shell magnetic particle 110 so as to extend to the void between the core-shell magnetic particles 110 in an aggregate of the core-shell magnetic particles 110. The antenna element 180 is formed around the core-shell magnetic material 100 while being in close contact with the second resin 140.

The second resin 140 has the glass-transition temperature of 60° C. or more, and preferably second resin 140 is the epoxy resin containing at least the acid anhydride as the hardener. Therefore, the compact, high-efficiency, high-reliability antenna is provided.

Preferably a distance from the antenna element to the magnetic member is increased in consideration of performance as the antenna. On the other hand, preferably the distance between the antenna element including the thickness of the second resin and the magnetic member is decreased in consideration of a mounting space. Therefore, the desirable distance between the antenna element and the magnetic member exists. As a result of the study, preferably the average value of the distance ranges from 0.01 mm to 1 mm, more preferably ranges from 0.1 mm to 0.5 mm. In the eleventh embodiment, the antenna element is in close contact with the second resin of the core-shell magnetic particle by way of example. Alternatively, the void or the space may exist partially between the antenna element and the core-shell magnetic particle.

(Twelfth Embodiment)

An antenna device according to a twelfth embodiment differs from the antenna device of the eleventh embodiment in that a dielectric body having permittivity lower than that of the core-shell magnetic material is inserted between the core-shell magnetic material and the antenna element.

Figure 11:
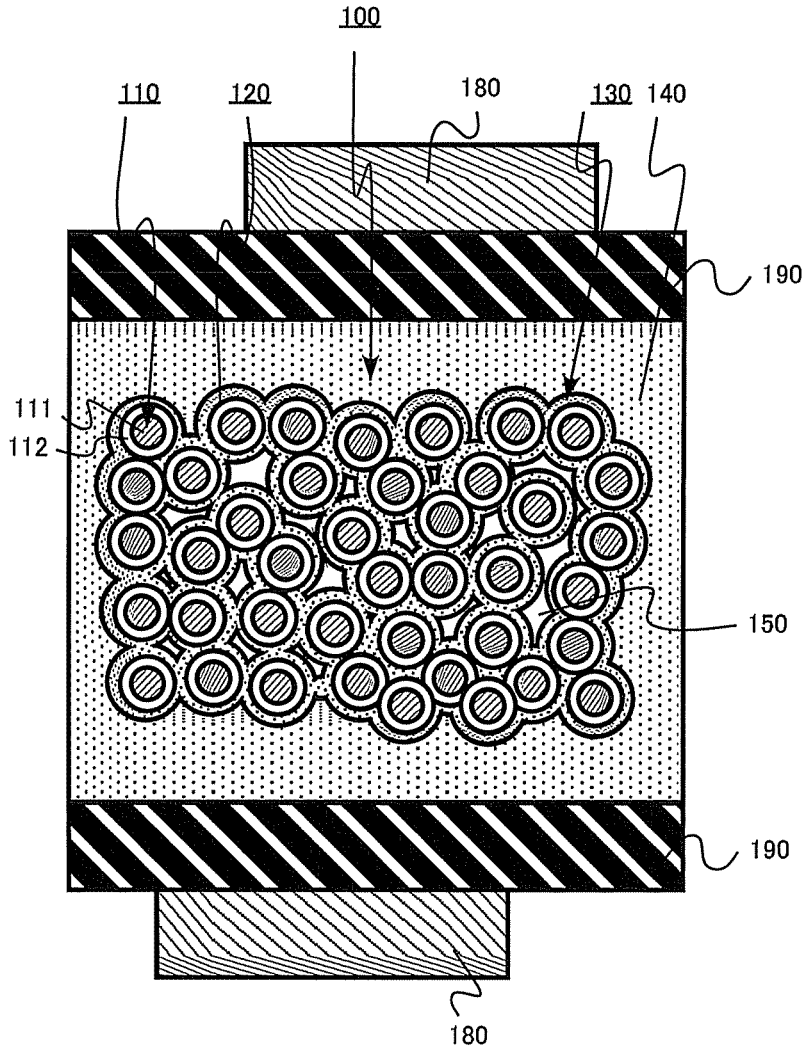
FIG. 11 is an explanatory view of a detailed antenna device according to a twelfth embodiment.

FIG. 11 is a sectional view illustrating a configuration of the antenna device of the twelfth embodiment. A dielectric body 190 is inserted between the core-shell magnetic material 100 and the antenna element 180. According to the twelfth embodiment, the more-compact, further-high-efficiency antenna is provided.

Preferably the dielectric body 190 is selected from homopolymers and copolymers of a liquid crystal polymer, an epoxy resin, a PVB, a PVA, a polystyrene, a polyolefin, a vinyl chloride resin, a cyanoacrylate resin, a nylon, a fluorine resin, a polycarbonate, an ethylcellulose, a polyvinyl acetate, a polyacrylonitrile, a PET, a polyphenyl ether, a polyacetal, a polyurethan, and a polyimide.

Preferably the dielectric body 190 inserted between the element and the composite material has the permittivity smaller than that of the core-shell magnetic material, more preferably the dielectric body 190 has a half of the permittivity of the core-shell magnetic material or less.

Because the core-shell magnetic material includes the magnetic member and the resin that covers the magnetic member, generally the permittivity of the core-shell magnetic material is larger than that of the single resin. In the antenna device of the twelfth embodiment, the radiation characteristic is degraded when the core-shell magnetic material that constitutes a magnetic core immediately below the antenna element has the large permittivity. Accordingly, when the dielectric body having the small permittivity is inserted between the antenna element and the core-shell magnetic material, the high radiation characteristic can be achieved compared with the case in which the antenna element is directly formed in the surface of the core-shell magnetic material.

Therefore, there is no particular limitation to the inserted dielectric body as long as the dielectric body has the permittivity smaller than that of the core-shell magnetic material. For example, the dielectric body is a low-permittivity ceramic or a composite material of a low-permittivity ceramic and a resin, paper, or a resin widely used in the industrial field.

Although there is no particular limitation to the dielectric body, preferably the dielectric body can easily cover the core-shell magnetic material from the industrial viewpoint. In view of this, preferably the dielectric body is selected from homopolymers and copolymers of a liquid crystal polymer, an epoxy resin, a PVB, a PVA, a polyolefin, a vinyl chloride resin, a cyanoacrylate resin, a nylon, a fluorine resin, a polycarbonate, a polystyrene, an ethylcellulose, a polyvinyl acetate, a polyacrylonitrile, a PET, a polyphenyl ether, a polyacetal, a polyurethan, and a polyimide.

As described above, in consideration of performance as the antenna, preferably the average value of the distance between the antenna element and the magnetic member ranges from 0.01 mm to 1 mm, more preferably ranges from 0.1 mm to 0.5 mm. Preferably the total of the thickness of the second resin and the thickness of the inserted dielectric body falls within the above range. The inserted dielectric body may include at least two layers in the production process. The void or the space may exist partially between the antenna element and the core-shell magnetic material.

(Thirteenth Embodiment)

A magnetic material according to a thirteenth embodiment includes: a magnetic member in which plural non-core-shell magnetic particles are bound by a binder made of a first resin; and a coating layer that is made of a second resin different from the first resin, a surface of the magnetic member being covered with the coating layer. The first resin is a polyvinyl polymer compound having a main backbone made of a hydrocarbon chain, the second resin is an epoxy resin, and the magnetic particle contains at least one magnetic metal selected from a group consisting of Fe, Co, and Ni.

The magnetic material of the thirteenth embodiment differs from the magnetic material of the first embodiment in that the magnetic particle is not the core-shell magnetic particle but the non-core-shell magnetic particle and that the materials for the first resin and the second resin are restricted. The description overlapping that of the first embodiment is not repeated here.

According to the thirteenth embodiment, even if the magnetic material is constructed by the non-core-shell magnetic particle that is inferior to the core-shell magnetic particle in the oxidation resistance, the magnetic material having the excellent characteristic in the high frequency band, particularly the GHz-band and the high environment resistance is made.

(Fourteenth Embodiment)

A magnetic material according to a fourteenth embodiment includes: a magnetic member in which a plurality of non-core-shell magnetic particles are bound by a binder made of a first resin; and a coating layer that is made of a second resin different from the first resin, a surface of the magnetic member being covered with the coating layer. The first resin is a polymer compound containing at least a butyral unit in a polyvinyl backbone, the second resin is an epoxy resin having a hardener component of an acid anhydride, and the magnetic particle contains at least one magnetic metal selected from a group consisting of Fe, Co, and Ni.

The magnetic material of the fourteenth embodiment differs from the magnetic material of the first embodiment in that the magnetic particle is not the core-shell magnetic particle but the non-core-shell magnetic particle and that the materials for the first resin and the second resin are restricted. The description overlapping that of the first embodiment is not repeated here.

According to the fourteenth embodiment, even if the magnetic material is constructed by the non-core-shell magnetic particle that is inferior to the core-shell magnetic particle in the oxidation resistance, the magnetic material having the excellent characteristic in the high frequency band, particularly the GHz-band and the high environment resistance is made.

The embodiments of the invention are described above by referring to the specific examples. However, the embodiments are described only by way of example, and the invention is not limited to the embodiments. In the embodiments, the description that does not relate directly to the invention is omitted in the core-shell magnetic material, the core-shell magnetic material producing method, the device, and the antenna device. However, a necessary element relating to the core-shell magnetic material, the core-shell magnetic material producing method, the device, and the antenna device can properly be selected and used.

Additionally, all the core-shell magnetic materials, the core-shell magnetic material producing methods, the devices, and the antenna devices, in which the elements of the invention are included and those skilled in the art can properly change the design, are included in the scope of the invention. The scope of the invention is defined by claims of the invention and a range of equivalents thereof.

EXAMPLES

Hereinafter, examples of the invention will be described in detail in contrast with comparative examples. In the following examples and comparative examples, the average particle diameter of the magnetic metallic particle and the oxide particle are measured based on the TEM observation. Specifically, the longest diagonal line and the shortest diagonal line of each particle are averaged as the particle diameter by the TEM observation (photograph), and the average particle diameter is fixed by the average of particle diameters. The photographs are taken at least three points with a unit area of 10 μm×10 μm, and the average value is obtained. The thickness of the oxide covering layer is fixed by the TEM observation. Specifically, the photographs are taken at least three points with a unit area of 10 μm×10 μm by the TEM observation, the oxide covering layer of each particle included in the unit area is fixed, and the average value is obtained. The ratio of the numbers of core-shell magnetic particles and oxide particles is calculated by counting the numbers of core-shell magnetic particles and oxide particles, which exist in the area. The volume ratio (a volume ratio of the oxide particle to a total volume of the oxide particle and the magnetic metallic particle) of the oxide particle is simply calculated from the average particle diameters of the oxide particle and the magnetic metallic particle and the ratio of the numbers of oxide particles and magnetic metallic particles.

The composition analysis of the fine structure is performed based on the EDX analysis. The ratio of nonmagnetic metal/magnetic metal (atomic ratio) in the oxide particle and the ratio of nonmagnetic metal/magnetic metal (atomic ratio) in the oxide covering layer are compared to each other by the EDX analysis.

(Synthesis of Core-Shell Magnetic Particle 1)

The argon is introduced as the plasma generating gas to a chamber of the high-frequency induction thermal plasma apparatus at a flow rate of 40 L/min to generate the plasma. The raw material includes a FeCoAl solid solution powder (Al amount is 2.5 at % to FeCo of 100) having the average particle diameter of 10 μm and the atomic ratio of Fe:Co:Al of 70:30:2.5 and an Al powder having the average particle diameter of 3 μm. The raw material of the magnetic metallic particle is sprayed into the plasma in the chamber with argon (carrier gas) at the flow rate of 3 L/min such that the Al powder becomes 5 at % with respect to FeCO of 100 in the solid solution powder (that is, in the total Al amount of 5 at % with respect to FeCo, 2.5 at % is loaded as the FeCoAl solid solution powder, and the residual 2.5 at % is loaded as the Al powder). Therefore, the magnetic metallic particle and the nonmagnetic metallic particle are produced.

At the same time as the spray is performed, the acetylene gas is introduced as the carbon covering raw material into the chamber along with the carrier gas, thereby obtaining the particle in which the magnetic metallic particle is covered with the carbon. The magnetic metallic particle covered with the carbon is subjected to the reduction treatment at the flow rate of 500 mL/min at 600° C. under a flow of hydrogen having a concentration of 99%. After the magnetic metallic particle is cooled to room temperature, the magnetic metallic particle is taken out in the oxygen containing atmosphere and oxidized, thereby producing the core-shell magnetic material. At this point, the nonmagnetic metallic particle is also oxidized to form the oxide particle.

The obtained core-shell magnetic material includes the core-shell magnetic metallic particle and the oxide particle, the magnetic metallic particle included in the core-shell magnetic metallic particle has the average particle diameter of 17±4 nm, and the oxide covering layer has the thickness of 1.7±0.3 nm. The magnetic metallic particle of the core is made of Fe—Co—Al—C, and the oxide covering layer is made of Fe—Co—Al—O.

In the XRD measurement of the magnetic metallic particle, only the peak of FeCO is detected, and FeCo has the lattice constant of about 2.87. That is, the solid solution of Al and C, which are contained in the magnetic metallic particle, in FeCo is formed, and a lattice of FeCo is slightly deformed by the core-shell structure with the small particle diameter. The solid solution of Al and C in FeCo can be confirmed by the diffraction pattern of the particle or the high-resolution TEM photograph using the TEM.

The thickness and the composition of the oxide covering layer have small variations and are homogeneous. Many oxide particles made of Al—O (partially solid solution of Al and O in FeCo) exist between the magnetic metallic particles. The oxide particle has the average particle diameter of about 10±3 nm. The particle diameter and the composition of the oxide particle have small variations and are homogeneous. The ratio of Al/(Fe+Co) in the oxide particle is larger than the ratio of Al/(Fe+Co) in the oxide covering layer. The number of oxide particles is about 50% of the number of core-shell magnetic particles.

(Synthesis of Core-Shell Magnetic Particle 2)

The argon is introduced as the plasma generating gas to a chamber of the high-frequency induction thermal plasma apparatus at a flow rate of 40 L/min to generate the plasma. The raw material of the magnetic metallic particle is sprayed into the plasma in the chamber with the argon (carrier gas) at the flow rate of 3 L/min. The raw material is the FeCoAl solid solution powder (Al amount is 5 at % to FeCo of 100) having the average particle diameter of 10 μm and the atomic ratio of Fe:Co:Al of 70:30:5.

At the same time as the spray is performed, the acetylene gas is introduced as the carbon covering raw material into the chamber along with the carrier gas, thereby obtaining the particle in which the magnetic metallic particle is covered with the carbon. The magnetic metallic particle covered with the carbon is subjected to the reduction treatment at the flow rate of 500 mL/min at 600° C. under a flow of hydrogen having a concentration of 99%. After the magnetic metallic particle is cooled to room temperature, the magnetic metallic particle is taken out in the oxygen containing atmosphere and oxidized, thereby producing the core-shell magnetic particle.

The magnetic metallic particle included in the core-shell magnetic metallic particle has the average particle diameter of 19±4 nm, and the oxide covering layer has the thickness of 1.9±0.3 nm. The magnetic metallic particle of the core is made of Fe—Co—Al—C, and the oxide covering layer is made of Fe—Co—Al—O.

In the XRD measurement of the magnetic metallic particle, only the peak of FeCO is detected, and FeCo has the lattice constant of about 2.87. That is, the solid solution of Al and C, which are contained in the magnetic metallic particle, in FeCo is formed, and a lattice of FeCo is slightly deformed by the core-shell structure with the small particle diameter. The solid solution of Al and C in FeCo can be confirmed by the diffraction pattern of the particle or the high-resolution TEM photograph using the TEM. The thickness and the composition of the oxide covering layer have small variations and are homogeneous.

Examples 1 to 5 and Comparative Examples 1 and 2

The core-shell magnetic particle prepared by the above method and the first resin are mixed at a weight ratio of 100:15 to thicken the film. The magnetic member in which the film is thickened is impregnated with the second resin in vacuum (−0.08 MPa or less), and dried and hardened to prepare the evaluation sample.

Example 6

The core-shell magnetic particle 1 prepared by the above method, Solsperse 20000 (product of Lubrizol), and the polyvinyl butyral resin (PVB: polyvinyl alcohol unit of 25%) are mixed at a weight ratio of 100:5:10 to thicken the film. The magnetic member in which the film is thickened is impregnated with the bisphenol F type epoxy resin in vacuum, and dried and hardened to prepare the evaluation sample.

Example 7

An acetone solution in which the core-shell magnetic particles 1 made of the FeCoAl alloy are mixed in the dispersant of Solsperse 20000 (product of Lubrizol) with the ratio of particle:dispersant=100:5 is prepared, and the dispersion treatment is performed for 10 minutes by an ultrasound homogenizer. The acetone is removed in the Ar atmosphere to form the powder. The epoxy resin (bisphenol F type/liquid hardener of acid anhydride) in the liquid state at room temperature is mixed in the powder at the ratio of controlled powder:epoxy resin=1:10, and mixing is simply performed with a blade mixer. The mixture is further mixed with the triple roll mill to obtain the particle-dispersed epoxy resin composition. The composition is subjected to press burning using a hot press machine. The composition is injected into the molding die heated at 120° C., and a pressure of 2 MPA is applied for 10 minutes, thereby tentatively hardening the resin. Then the molded pellet is put in an oven at 150° C., the resin is hardened to obtain the magnetic material, and the magnetic material is used as the evaluation sample.

Example 8

Similarly to Example 6, the particle, Solsperse 20000, and the PVB are mixed in the acetone such that the ratio of particle:Solsperse 20000:PVB becomes 100:5:30 (weight ratio). After the film is formed, the mixture is molded in the molding die at 120° C., and the magnetic material is prepared by the same method as Example 1, thereby obtaining the evaluation sample.

Comparative Example 3

The magnetic material is prepared to obtain the evaluation sample by the same process except that the polyvinyl butyral resin having the polyvinyl alcohol unit of 35% is used instead of the polyvinyl butyral resin having the polyvinyl alcohol unit of 25% in Example 6.

TABLE 1 illustrates outlines of the core-shell magnetic particle, the first resin, and the second resin, which are used in Examples 1 to 8 and Comparative Examples 1 to 3. TABLE 2 illustrates contents and characteristics of the resins used as the first resin and the second resin. The magnetic permeability real part (μ') and a change with time of the magnetic permeability real part (μ') after 100 hours are checked with respect to the evaluation materials of Examples 1 to 5 and Comparative Examples 1 and 2 using the method described above. TABLE 3 illustrates the result.

In TABLE 3, "not available" means that the magnetic material cannot be made because the first resin is swelled during the impregnation of the second resin. When the first resin and the second resin are made of the same resin, unfortunately the desired structure cannot be formed.

1) Magnetic Permeability Real Part μ'

An induced voltage value and an impedance value are measured with a system PMM-9G1 (product of Ryouwa Electronics Co., Ltd.) in both the case that air is used as a background at 1 GHz and the case that the sample is placed. The magnetic permeability real part μ' is derived from the induced voltage value and the impedance value. The sample is used while processed into a size of 4×4×0.5 mm.

2) Change with Time of Magnetic Permeability Real Part μ' after 100 Hours

After the evaluation sample is left in a high-temperature constant-humidity oven at a temperature of 60° C. and humidity of 90% for 100 hours, the magnetic permeability real part μ' is measured again to determine the change with time (magnetic permeability real part μ' after 100 hours/magnetic permeability real part μ' before left).

TABLE 1

| | Core-shell magnetic particle | First resin | Second resin | Dispersant |
|---|---|---|---|---|
| Example 1 | 1 | PVB | Epoxy A | without |
| Example 2 | 2 | PVB | Teflon | without |
| Example 3 | 1 | Epoxy B | PVB | without |
| Example 4 | 2 | Polybutadiene | Epoxy A | without |
| Example 5 | 2 | PVB | Polybutadiene | without |
| Example 6 | 1 | PVB | Epoxy A | with |
| Example 7 | 1 | Polymer | Epoxy A | with |

TABLE 1-continued

| | Core-shell magnetic particle | First resin | Second resin | Dispersant |
|---|---|---|---|---|
| | | compound | | |
| Example 8 | 1 | PVB | Epoxy A | with |
| Comparative example 1 | 2 | PVB | without | without |
| Comparative example 2 | 2 | PVB | PVB | without |
| Comparative example 3 | 1 | PVB | Epoxy A | with |

TABLE 2

| Resin | Resin composition | | | Characteristics | |
|---|---|---|---|---|---|
| | | | | Water absorption | Oxygen permeability coefficient ($cm^3cm/$ |
| type | Resin | Hardener | Catalyst | percentage | $(cm^2 \cdot s \cdot Pa)$) |
| Epoxy A | Bisphenol F type | Acid anhydride | Imidazole | 0.05% | $0.0045 \times 10^{-12}$ |
| Epoxy B | Bisphenol A type | Amine system | — | 0.10% | $0.0075 \times 10^{-12}$ |
| PVB | Polyvinyl butyral | — | — | 5-8% | $0.081 \times 10^{-12}$ |
| Poly butadiene | Poly butadiene | — | — | | $1.71 \times 10^{-12}$ |
| Teflon | PTFE | — | — | 0% | $0.5 \times 10^{-12}$ |

TABLE 3

| | Characteristics of high-frequency magnetic material | |
|---|---|---|
| | Magnetic permeability real part (at 1 GHz) | Change with time of magnetic permeability real part μ' after 100 hours (at 1 GHz) |
| Example 1 | 4.9 | 0.999 |
| Example 2 | 4.7 | 0.990 |
| Example 3 | 4.8 | 0.997 |
| Example 4 | 4.6 | 0.990 |
| Example 5 | 4.7 | 0.910 |
| Example 6 | 5.2 | 0.911 |
| Example 7 | 5.3 | 0.955 |
| Example 8 | 4.8 | 0.901 |
| Comparative example 1 | 4.7 | 0.880 |
| Comparative example 2 | Not available | Not available |
| Comparative example 3 | 5.0 | 0.761 |

As is clear from TABLE 3, compared with the magnetic materials of Comparative Examples 1 and 3, the core-shell magnetic materials of Examples 1 to 5 has the significantly high thermal stability because the change with time of the magnetic permeability real part (μ') after 100 hours is small. This is because the second resin prevents the oxygen and the moisture in air from invading into the core-shell magnetic materials of Examples 1 to 5.

In the core-shell magnetic materials of Examples to 8, the dispersibility of the core-shell magnetic particle is improved to increase packing density of the composite material, thereby further improving the permeability.

Although the magnetic permeability real part (μ') is illustrated only at 1 GHz, the magnetic permeability real part (μ') exhibits a flat frequency characteristic, and the magnetic permeability real part (μ') has the substantially same value at 100 MHz.

As described above, the core-shell magnetic materials of Examples 1 to 8 have the high magnetic permeability real part (μ') at 1 GHz and the high thermal stability, so that the core-shell magnetic materials of Examples 1 to 8 have the probability that the core-shell magnetic materials can be used as high-permeability components (high μ' and low μ" are used) such as the inductor, the filter, the transformer, the choke coil, and the antenna board for the mobile phone or wireless LAN at 1-GHz band. It can be demonstrated that the core-shell magnetic materials of Examples 1 to 8 have the high environment resistance.

Example 9

The core-shell magnetic particle, the PVB, and the acetone are mixed and molded to obtain the magnetic member. The magnetic member is put in the epoxy resin under reduced pressure, the surface of the magnetic member is covered with the epoxy resin while the magnetic member is impregnated with the epoxy resin, and the epoxy resin is hardened. The permittivity of the core-shell magnetic material has the real part of 15. A magnetic dielectric body made of the core-shell magnetic material is prepared by the above technique, and the antenna element is formed on the surface of the magnetic dielectric body to prepare the magnetic dielectric antenna. At this point, the spacing of 0.1 mm exists between the antenna element and the magnetic member, and the epoxy resin is formed in the spacing.

When the radiation efficiency of the magnetic dielectric antenna is measured, the radiation efficiency is improved by 1.0 dB compared with the cavity antenna with no use of the magnetic core. When a thermal aging test is performed at 85° C., the radiation efficiency is not degraded even after 100 hours.

Example 10

The magnetic member is prepared by the same technique as Example 9. Unlike Example 9, the surface of the magnetic member is covered with the epoxy resin while the magnetic member is impregnated with the epoxy resin. While the epoxy resin is not hardened, the magnetic body made of the core-shell magnetic material is inserted in the cavity antenna in which the antenna element is formed around a casing made of the liquid crystal polymer whose permittivity has the real part of 3. Then, the epoxy resin is hardened under the same heat treatment condition as Example 9, thereby preparing the magnetic dielectric antenna. The permittivity of the single core-shell magnetic material has the real part of 15 because of the same material as Example 9. The spacing between the antenna element and the magnetic member (the sum of the thickness of the epoxy resin and the thickness of the liquid crystal polymer) is 0.4 mm. When the radiation efficiency of the magnetic dielectric antenna is measured, the radiation efficiency is improved by 1.5 dB compared with the cavity antenna with no use of the magnetic core. When the thermal aging test is performed at 85° C., the radiation efficiency is not degraded even after 100 hours.

Example 11

The magnetic dielectric antenna in which the epoxy resin is used instead of the PVB is prepared by the same technique as Example 9. At this point, the permittivity of the core-shell magnetic material has the real part of 14. The spacing between the antenna element and the core-shell magnetic material is 0.1 mm. When the radiation efficiency of the magnetic dielectric antenna is measured, the radiation efficiency is improved by 1.5 dB compared with the cavity antenna with no use of the magnetic core. When a thermal aging test is performed at 85° C., the radiation efficiency is not degraded even after 100 hours.

Comparative Example 4

In Example 9, the antenna element is formed without impregnating the magnetic member with the resin, and the magnetic dielectric antenna is prepared. When the radiation efficiency of the magnetic dielectric antenna is measured, the radiation efficiency is degraded by −1.5 dB compared with the cavity antenna. In the thermal aging test performed at 85° C., the radiation efficiency is degraded by −2.0 dB after 20 hours, and the radiation efficiency is degraded by −2.5 dB after 100 hours.

Comparative Example 5

In Example 9, while the resin impregnation is not performed, dipping is performed to insert the resin in the cavity antenna, and the magnetic dielectric antenna is prepared. The radiation efficiency of the antenna is improved by 1.5 dB compared with the cavity antenna. However, in the thermal aging test performed at 85° C., the radiation efficiency is degraded by −1.8 dB after 20 hours, and the radiation efficiency is degraded by −2.0 dB after 100 hours.

In Examples 9 to 11, the high-radiation-efficiency, excellent-environment-resistance antenna device can be produced by the antenna structure of the eleventh or twelfth embodiment.

Example 12

Example 12 differs from Example 1 only in that the non-core-shell magnetic particle is used instead of the core-shell magnetic particle. Therefore, the same description as Example 1 is not repeated, and different points are mainly described. An $Fe_{70}Co_{30}$ nano particle is used as the non-core-shell particle. Similarly to the $Fe_{70}Co_{30}$ nano particle, the magnetic metallic particle containing Fe, Co, or Ni or Fe system oxide particles such as a ferrite can also be used as a modification. The characteristics of the particle used in Example 12 are identical to those of the particle produced in Example 1, and advantageously the particle of Example 12 can be formed without a special producing process by the use of the general-purpose raw material. The same structure and characteristic as Example 9 can be obtained in the case that the antenna device is made of the general-purpose raw material.

REFERENCE SIGNS LIST

2 Core-shell magnetic material
4 Feeding terminal
6 Antenna element
8 Wiring board
10 Finite ground plane
12 Rectangular conductor plate, Comb-shape linear conductor
14 Antenna
16 Magnetic body
**16*a*** First magnetic body layer
**16*b*** Second magnetic body layer
18 Bent portion
20 Coaxial line
22 Feeding point
24 Core-shell magnetic material
26 Wiring board
28 Feeding terminal of antenna
30 Antenna element
32 Antenna movable portion
34 Movable direction
36 Antenna cover
**36*a*** Box portion
**36*b*** Cap portion
**36*c*** Cavity
100 Core-shell magnetic material
110 Core-shell magnetic particle
111 Magnetic metallic particle
112 Covering layer
113 Polymer compound
120 Binder
130 Magnetic member
140 Coating layer
150 Void
180 Antenna element
190 Dielectric body
200 Core-shell magnetic material
300 Core-shell magnetic material

The invention claimed is:

1. A core-shell magnetic material comprising:

a magnetic member in which a plurality of core-shell magnetic particles are bound by a binder made of a first resin; and a coating layer that is made of a second resin different from the first resin, a surface of the magnetic member being covered with the coating layer, the coating layer being disposed directly on the binder, wherein the core-shell magnetic particle includes a magnetic metallic particle and a covering layer that covers at least part of a surface of the magnetic metallic particle, the magnetic metallic particle contains at least one magnetic metal selected from a group consisting of Fe, Co, and Ni, and the covering layer is made of an oxide, a nitride, or a carbide that contains at least one magnetic metal that contained in the magnetic metallic particle, and wherein an oxygen permeability coefficient of the second resin is lower than an oxygen permeability coefficient of the first resin, and a water absorption percentage of the second resin is lower than a water absorption percentage of the first resin.

2. The core-shell magnetic material according to claim 1, wherein an oxygen permeability coefficient of the second resin is $1.70\times10^{-12}$ $cm^3\times cm/(cm^2\times s\times Pa)$ or less.

3. The core-shell magnetic material according to claim 1, wherein the magnetic member further contains an oxide particle, a nitride particle, or a carbide particle that exists in at least part between the magnetic metallic particles and contains at least one nonmagnetic metal selected from Mg, Al, Si, Ca, Zr, Ti, Hf, Zn, Mn, a rare-earth element, Ba, and Sr.

4. The core-shell magnetic material according to claim 1, comprising a polymer compound in at least part of a surface of the core-shell magnetic particle, the polymer compound containing at least an oxyethylene unit and an amino group in a molecular chain.

5. The core-shell magnetic material according to claim 1, wherein the first resin contains a polymer compound including at least an oxyethylene unit and an amino group in a molecular chain.

6. The core-shell magnetic material according to claim 1, wherein a hydroxyl group existing in a molecular chain of the first resin or the second resin is 30% or less per repeating unit.

7. The core-shell magnetic material according to claim 1, wherein the first resin is a polyvinyl polymer compound having a main backbone made of a hydrocarbon chain, and the second resin is an epoxy resin.

8. The core-shell magnetic material according to claim 1, wherein the first resin is a polymer compound containing at least a butyral unit in a polyvinyl backbone, and the second resin is an epoxy resin having a hardener component of an acid anhydride.

9. A core-shell magnetic material producing method comprising the steps of:

producing a magnetic metallic particle made of a magnetic metal and a nonmagnetic metal;

forming a core-shell magnetic particle by oxidizing, nitriding, or carbonizing the magnetic metallic particle;

preparing a kneading matter by mixing the core-shell magnetic particle in liquid containing a first resin;

forming a magnetic member by molding the kneading matter; and forming a coating layer by impregnating a surface of the magnetic member with a second resin, wherein the magnetic metal is at least one magnetic metal selected from a group consisting of Fe, Co, and Ni, and the nonmagnetic metal is at least one nonmagnetic metal selected from Mg, Al, Si, Ca, Zr, Ti, Hf, Zn, Mn, a rare-earth element, Ba, and Sr, and wherein an oxygen permeability coefficient of the second resin is lower than an oxygen permeability coefficient of the first resin, and a water absorption percentage of the second resin is lower than a water absorption percentage of the first resin.

10. The core-shell magnetic material producing method according to claim 9, wherein a solid solution powder of the magnetic metal and the nonmagnetic metal and a nonmagnetic metallic particle are used as a raw material in the magnetic metallic particle producing step.

11. The core-shell magnetic material producing method according to claim 9, wherein the coating layer forming step is performed under reduced pressure.

12. A core-shell magnetic material producing method comprising the steps of:

producing a magnetic metallic particle made of a magnetic metal and a nonmagnetic metal;

forming a core-shell magnetic particle by oxidizing, nitriding, or carbonizing the magnetic metallic particle;

preparing a dispersion liquid in which the core-shell magnetic particles are dispersed in a solvent by mixing the core-shell magnetic particles in the solvent containing a polymer compound including at least an oxyethylene unit and an alkylamino group in a molecular chain and a polymer compound having a main backbone made of a hydrocarbon chain;

forming a film by molding the dispersion liquid and forming a coating layer by impregnating a surface of the magnetic member with a second resin, wherein the magnetic metal is at least one magnetic metal selected from a group consisting of Fe, Co, and Ni, and the nonmagnetic metal is at least one nonmagnetic metal selected from Mg, Al, Si, Ca, Zr, Ti, Hf, Zn, Mn, a rare-earth element, Ba, and Sr, and wherein an oxygen permeability coefficient of the second resin is lower than an oxygen permeability coefficient of the first resin.

13. The core-shell magnetic material producing method according to claim 12, wherein a vapor pressure of the solvent is 10 mmHg or more at 20° C.

14. A device comprising the core-shell magnetic material according to claim 1.

15. An antenna device comprising the core-shell magnetic material according to claim 1.

16. An antenna device comprising:

a finite ground plane;

a rectangular conductor plate that is provided above the finite ground plane, one side of the rectangular conductor plate being connected to the finite ground plane, the rectangular conductor plate including a bent portion substantially parallel to the one side;

an antenna that is disposed above the finite ground plane in substantially parallel with the finite ground plane, the antenna extending in a direction substantially perpendicular to the one side, a feeding point of the antenna being located near the other side disposed opposite the one side of the rectangular conductor plate; and a magnetic body that is provided at least part of a space between the finite ground plane and the antenna, wherein the magnetic body is the core-shell magnetic material according to claim 1.

17. The antenna device according to claim 15, comprising an antenna element that is formed around the core-shell magnetic material.

18. The antenna device according to claim 17, wherein a predetermined spacing is formed between the magnetic member and the antenna element.

19. The antenna device according to claim 18, wherein the spacing ranges from 0.01 mm to 1 mm.

20. The antenna device according to claim 17, wherein a dielectric body having permittivity lower than that of the core-shell magnetic material is inserted between the core-shell magnetic material and the antenna element.

21. A magnetic material comprising:

a magnetic member in which a plurality of non-core-shell magnetic particles are bound by a binder made of a first resin; and a coating layer that is made of a second resin different from the first resin, a coating layer that is made of a second resin different from the first resin, a surface of the magnetic member being covered with the coating layer, the coating layer being disposed directly on the binder, wherein the first resin is a polyvinyl polymer compound having a main backbone made of a hydrocarbon chain, the second resin is an epoxy resin, and the magnetic particle contains at least one magnetic metal selected from a group consisting of Fe, Co, and Ni, and wherein an oxygen permeability coefficient of the second resin is lower than an oxygen permeability coefficient of the first resin.

22. A magnetic material comprising:

a magnetic member in which a plurality of non-core-shell magnetic particles are bound by a binder made of a first resin; and a coating layer that is made of a second resin different from the first resin, a surface of the magnetic member being covered with the coating layer, the coating layer being disposed directly on the binder, wherein the first resin is a polymer compound contains at least a butyral unit in a polyvinyl backbone, and the second resin is an epoxy resin having a hardener component of an acid anhydride, and the magnetic particle contains at least one magnetic metal selected from a group consisting of Fe, Co, and Ni, and wherein an oxygen permeability coefficient of the second resin is lower than an oxygen permeability coefficient of the first resin.

23. The core-shell magnetic material according to claim 1, wherein the outer surface of the magnetic member is completely covered with the coating layer.

24. The core-shell magnetic material according to claim 1, wherein the magnetic member includes a void.

25. A core-shell magnetic material comprising:

a magnetic member in which a plurality of core-shell magnetic particles are bound by a binder made of a first resin; and a coating layer that is made of a second resin different from the first resin, a surface of the magnetic member being covered with the coating layer, the coating layer being disposed directly on the binder, wherein the core-shell magnetic particle includes a magnetic metallic particle and a covering layer that covers at least part of a surface of the magnetic metallic particle, the magnetic metallic particle contains at least one magnetic metal selected from a group consisting of Fe, Co, and Ni, and the covering layer is made of an oxide, a nitride, or a carbide that contains at least one magnetic metal that contained in the magnetic metallic particle, and wherein an oxygen permeability coefficient of the second resin is lower than an oxygen permeability coefficient of the first resin, and the first resin is a resin selected from PVB, PVA, an epoxy resin, a polybutadiene resin, polytetrafluoroethylene, and polystyrene resin, and the second resin is a resin selected from the PVB, the epoxy resin, and polytetrafluoroethylene.

26. The core-shell magnetic material according to claim 25, wherein an oxygen permeability coefficient of the second resin is $1.70\times10^{-12}$ $cm^3\times cm/(cm^2\times s\times Pa)$ or less.

27. The core-shell magnetic material according to claim 25, wherein the magnetic member further contains an oxide particle, a nitride particle, or a carbide particle that exists in at least part between the magnetic metallic particles and contains at least one nonmagnetic metal selected from Mg, Al, Si, Ca, Zr, Ti, Hf, Zn, Mn, a rare-earth element, Ba, and Sr.

28. The core-shell magnetic material according to claim 25, comprising a polymer compound in at least part of a surface of the core-shell magnetic particle, the polymer compound containing at least an oxyethylene unit and an amino group in a molecular chain.

29. The core-shell magnetic material according to claim 25, wherein the first resin contains a polymer compound including at least an oxyethylene unit and an amino group in a molecular chain.

30. The core-shell magnetic material according to claim 25, wherein a hydroxyl group existing in a molecular chain of the first resin or the second resin is 30% or less per repeating unit.

31. The core-shell magnetic material according to claim 25, wherein the first resin is a polyvinyl polymer compound having a main backbone made of a hydrocarbon chain, and the second resin is an epoxy resin.

32. The core-shell magnetic material according to claim 25, wherein the first resin is a polymer compound containing at least a butyral unit in a polyvinyl backbone, and the second resin is an epoxy resin having a hardener component of an acid anhydride.

33. A core-shell magnetic material producing method comprising the steps of:

producing a magnetic metallic particle made of a magnetic metal and a nonmagnetic metal;

forming a core-shell magnetic particle by oxidizing, nitriding, or carbonizing the magnetic metallic particle;

preparing a kneading matter by mixing the core-shell magnetic particle in liquid containing a first resin;

forming a magnetic member by molding the kneading matter; and forming a coating layer by impregnating a surface of the magnetic member with a second resin, wherein the magnetic metal is at least one magnetic metal selected from a group consisting of Fe, Co, and Ni, and the nonmagnetic metal is at least one nonmagnetic metal selected from Mg, Al, Si, Ca, Zr, Ti, Hf, Zn, Mn, a rare-earth element, Ba, and Sr, and wherein an oxygen permeability coefficient of the second resin is lower than an oxygen permeability coefficient of the first resin, and the first resin is a resin selected from PVB, PVA, an epoxy resin, a polybutadiene resin, polytetrafluoroethylene, and polystyrene resin, and the second resin is a resin selected from the PVB, the epoxy resin, and polytetrafluoroethylene.

34. The core-shell magnetic material producing method according to claim 33, wherein a solid solution powder of the magnetic metal and the nonmagnetic metal and a nonmagnetic metallic particle are used as a raw material in the magnetic metallic particle producing step.

35. The core-shell magnetic material producing method according to claim 33, wherein the coating layer forming step is performed under reduced pressure.

36. A device comprising the core-shell magnetic material according to claim 25.

37. An antenna device comprising the core-shell magnetic material according to claim 25.

38. An antenna device comprising:

a finite ground plane;

a rectangular conductor plate that is provided above the finite ground plane, one side of the rectangular conductor plate being connected to the finite ground plane, the rectangular conductor plate including a bent portion substantially parallel to the one side;

an antenna that is disposed above the finite ground plane in substantially parallel with the finite ground plane, the antenna extending in a direction substantially perpendicular to the one side, a feeding point of the antenna being located near the other side disposed opposite the one side of the rectangular conductor plate; and a magnetic body that is provided at least part of a space between the finite ground plane and the antenna, wherein the magnetic body is the core-shell magnetic material according to claim 25.

39. The antenna device according to claim 37, comprising an antenna element that is formed around the core-shell magnetic material.

40. The antenna device according to claim 39, wherein a predetermined spacing is formed between the magnetic member and the antenna element.

41. The antenna device according to claim 40, wherein the spacing ranges from 0.01 mm to 1 mm.

42. The antenna device according to claim 39, wherein a dielectric body having permittivity lower than that of the core-shell magnetic material is inserted between the core-shell magnetic material and the antenna element.

43. The core-shell magnetic material according to claim 25, wherein the outer surface of the magnetic member is completely covered with the coating layer.

44. The core-shell magnetic material according to claim 25, wherein the magnetic member includes a void.

* * * * *